US012011752B2

(12) United States Patent
Radtke et al.

(10) Patent No.: US 12,011,752 B2
(45) Date of Patent: Jun. 18, 2024

(54) BATTERY PACK POWERED ROLL GROOVER

(71) Applicant: MILWAUKEE ELECTRIC TOOL CORPORATION, Brookfield, WI (US)

(72) Inventors: Timothy J. Radtke, New Berlin, WI (US); Benjamin A. Sands, Jackson, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 56 days.

(21) Appl. No.: 17/505,266

(22) Filed: Oct. 19, 2021

(65) Prior Publication Data

US 2022/0118498 A1 Apr. 21, 2022

Related U.S. Application Data

(60) Provisional application No. 63/235,507, filed on Aug. 20, 2021, provisional application No. 63/093,577, filed on Oct. 19, 2020.

(51) Int. Cl.
*B21D 17/04* (2006.01)

(52) U.S. Cl.
CPC ..... *B21D 17/04* (2013.01)

(58) Field of Classification Search
CPC ..... B21D 17/04; B21D 17/00
See application file for complete search history.

(56) References Cited

U.S. PATENT DOCUMENTS 5,727,411 A * 3/1998 Sakakibara ..... B21D 17/04 72/110
6,272,895 B1 8/2001 Hamm
6,591,652 B1 7/2003 Hamm et al.
6,968,761 B2 11/2005 Frank
9,586,275 B2 3/2017 Priha et al.
(Continued)

FOREIGN PATENT DOCUMENTS

DE 9216442 U1 1/1993
DE 4407613 A1 3/1995
(Continued)

OTHER PUBLICATIONS

International Search Report and Written Opinion for Application No. PCT/US2021/055620 dated Feb. 16, 2022 (13 pages).

*Primary Examiner* — Debra M Sullivan

(74) *Attorney, Agent, or Firm* — Michael Best & Friedrich LLP

(57) ABSTRACT

Battery pack powered roll groover described herein includes a housing, an inner roller provided on the housing and configured to be received in an inner circumference of a workpiece, a groove roll provided on the housing and configured to produce a groove on the workpiece, one or more motors provided within the housing and configured to drive the groove roll, and an electronic processor electrically connected to the one or more motors. The electronic processor is configured to operate the one or more motors to perform a first operation of moving the groove roll in a radial direction, and operate the one or more motors to perform a second operation of moving the groove roll around a track in a circumferential direction. The first operation is performed to adjust a groove depth on the workpiece. The second operation is performed to produce the groove on the workpiece.

18 Claims, 14 Drawing Sheets

(56) References Cited

U.S. PATENT DOCUMENTS

| | | | | |
|---|---|---|---|---|
| 9,956,617 | B2 | 5/2018 | Conrad et al. | |
| 9,962,769 | B2 | 5/2018 | Conrad et al. | |
| 10,456,840 | B2 | 10/2019 | Conrad et al. | |
| 2006/0230802 | A1 | 10/2006 | Andre | |
| 2015/0040632 | A1* | 2/2015 | Puzio | B21D 17/04 33/773 |

FOREIGN PATENT DOCUMENTS

| | | | |
|---|---|---|---|
| EP | 3666435 | A1 | 6/2020 |
| KR | 1020090005559 | A | 1/2009 |
| KR | 101838007 | B1 | 3/2018 |
| KR | 1020190001993 | A | 1/2019 |

* cited by examiner

BATTERY PACK POWERED ROLL GROOVER

RELATED APPLICATIONS

This application claims the benefit of U.S. Provisional Patent Application No. 63/093,577, filed on Oct. 19, 2020, and U.S. Provisional Patent Application No. 63/235,507, filed on Aug. 20, 2021, the entire content of each of which is hereby incorporated by reference.

BACKGROUND

In the pipe fitting industry, different methods are used to join two separate pieces of piping together. In one example, ends of the pipes are threaded and a threaded adapter is used to join the pipes together. An alternative to a threaded connection is a grooved connection. Specifically, a pipe is cut to the desired length and a groove is rolled onto an end of the pipe. A grooved adapter is then used to join the pipe to another pipe.

SUMMARY

Grooved pipe connections are especially useful to join pipes carrying water and/or steam and to provide a watertight seal between the pipes. A roll groover is used to produce a groove on the pipes. Roll groovers are typically mechanical devices that are placed on a pipe. A skilled user uses a crank mechanism to rotate the roll groover around the pipe to roll the groove onto the pipe. The crank mechanism involved manually rotating a crank by hand to rotate the roll groover.

Current roll groovers require skilled users to operate and take a large amount of time to complete one operation. Accordingly, there is a need for automated roll groovers that are simple to operate and reduce the operation time compared to current roll groovers.

Some embodiments provide a roll groover including a housing, an inner roller configured to be received in an inner circumference of a workpiece provided on the housing, and a groove roll configured to produce a groove on the workpiece provided on the housing. The roll groover includes a first motor to move the groove roll towards and away from the workpiece and a second motor to move the groove roll around a track and a circumference of the workpiece. The roll groover includes an electronic processor connected to the first motor and the second motor. The electronic processor is configured to operate the first motor to adjust the groove depth on the workpiece and the second motor to produce the groove on the workpiece.

Some embodiments provide a roll groover including a housing, an inner roller provided on the housing and configured to be received in an inner circumference of a workpiece, a groove roll provided on the housing and configured to produce a groove on the workpiece, one or more motors provided within the housing and configured to drive the groove roll, and an electronic processor electrically connected to the one or more motors. The electronic processor is configured to operate the one or more motors to perform a first operation of moving the groove roll in a radial direction. The first operation is performed to adjust a groove depth on the workpiece. The electronic processor is also configured to operate the one or more motors to perform a second operation of moving the groove roll in a circumferential direction. The second operation is performed to produce the groove on the workpiece.

In some aspects, the one or more motors include a first motor configured to drive the groove roll in the radial direction, and a second motor configured to drive the groove roll in the circumferential direction.

In some aspects, the roll groover also includes an inertial measurement unit configured to determine a position of the groove roll.

In some aspects, the electronic processor is also configured to control the one or more motors to move the groove roll around the workpiece while measuring a distance, and increase, using the one or more motors, groove depth in predetermined increments for each rotation of the groove roll by a first predetermined distance.

In some aspects, the roll groover also includes a battery pack configured to power the one or more motors.

In some aspects, the groove roll is provided on a circumferentially outer side of the inner roller.

In some aspects, the roll groover also includes a roll casing provided on the housing, wherein the groove roll is mounted to and moves with the roll casing. The roll casing with the groove roll moves around the track to produce the groove on the workpiece.

In some aspects, the roll groover also includes a jog trigger and a direction switch for selecting a direction of movement of the groove roll. The first operation is controlled using the jog trigger.

In some aspects, the roll groover also includes a run switch a direction switch for selecting a direction of movement of the groove roll. The second operation is controlled using the run switch.

In some aspects, the roll groover also includes one or more circuit boards provided within the housing and including electronic components of the roll groover. The one or more circuit boards includes a total surface area of less than 155 centimeters squared (cm2).

In some aspects, the electronic processor is also configured to detect an actuation of an arm/disarm button, control the one or more motors to move the groove roll toward the workpiece, detect, using one or more sensors, a current drawn by the one or more motors, determine whether the current exceeds an arm threshold, control the one or more motors to stop when the current exceeds the arm threshold, and provide an indication that the roll groover is armed.

In some aspects, the electronic processor is also configured to detect actuation of an arm/disarm button, control the one or more motors to move the groove roll away from the workpiece, determine whether the groove roll is at a home position, control the one or more motors to stop when the groove roll is at the home position, and provide an indication that the roll groover is disarmed.

In some aspects, the electronic processor is also configured to detect actuation of a jog trigger, control the one or more motors to move the groove roll toward the workpiece, and determine whether the jog trigger is still actuated. In response to the jog trigger continued to be activated, the electronic processor is configured to detect, using one or more sensors, a current drawn by the one or more motors, determine whether the current exceeds an arm threshold, control the one or more motors to stop when the current exceeds the arm threshold, and provide an indication that the roll groover is armed. In response to the jog trigger not being actuated, the electronic processor is configured to control the one or more motors to stop.

In some aspects, the electronic processor is also configured to detect actuation of a run button, determine, using an inertial measurement unit, an initial position of the groove roll, control the one or more motors to move the groove roll around the workpiece while measuring distance, determine whether the groove roll has rotated 360°, control the one or more motors to stop and record a measured distance when the groove roll has rotated 360°, determine a groove depth based on the measured distance.

In some aspects, the electronic processor is also configured to control the one or more motors to move the groove roll around the workpiece while measuring distance, determine whether the groove roll has traveled a first predetermined distance around a circumference of the workpiece, and determine whether the groove roll is below a second predetermined distance of a final depth when the groove roll has traveled the first predetermined distance. In response to the groove roll not being below the second predetermined distance of the final depth, the electronic processor is configured to control the one or more motors to increase groove depth by a predetermined increment. In response to the groove roll being below the second predetermined distance of the final depth, the electronic processor is configured to control the one or more motors to increase groove depth by a fractional increment, control the one or more motors to move the groove roll around the workpiece, determine whether the groove roll is at an initial position, and control the one or more motors to stop and indicate completion of operation when the groove roll is at the initial position.

In some aspects, the electronic processor is also configured to receive a selection of a single revolution mode, and control the one or more motors to complete a single revolution of the groove roll around the workpiece.

In some aspects, the roll groover also includes one or more light detection and ranging (LiDAR) sensors configured to detect objects in a vicinity of the roll groover. The electronic processor is further configured to detect that the roll groover is stationary, receive sensor data from the one or more LiDAR sensors, generate a base 3D point cloud based on the sensor data, continue operation of the roll groover, continuously scan the one or more LiDAR sensors to generate an updated 3D point cloud, compare the updated 3D point cloud to the base 3D point cloud, and determine whether an abnormal object is detected in the updated 3D point cloud. In response to detecting the abnormal object, the electronic processor is configured to determine whether the abnormal object is within a predetermined distance of the roll groover, and stop operation of the roll groover when the abnormal object is within the predetermined distance of the roll groover.

In some aspects, the inner roller includes a roller groove and the groove roll includes a roller projection corresponding to the roller groove. A force exerted by the roller projection on an outer circumference of the workpiece and an allowance provided by the roller groove on the inner circumference of the workpiece together produce the groove on the workpiece.

In some aspects, the groove roll is a replaceable die.

In some aspects, the electronic processor is also configured to receive a selection for measuring n amount of wear on the replaceable die, retrieve an initial distance an unworn replaceable die moves from a disarmed initial position to contact a fixed point, control the one or more motors to move the groove roll from the disarmed initial position to the fixed point in response to receiving the selection, measure a distance moved by the groove roll when the groove roll is moved from the disarmed initial position to contact the fixed point, determine whether the measured distance is greater than the initial distance, generate a first indication that the replaceable die is worn when the measured distance is greater than the initial distance, and generate a second indication that the replaceable die is unworn when the measured distance is not greater than the initial distance.

In some aspects, the groove roll and the inner roller form a replaceable die set.

In some aspects, the electronic processor is further configured to determine identification information of the replaceable die set.

In some aspects, the electronic processor is also configured to receive a selection for measuring workpiece dimension, retrieve an initial distance the groove roll moves from a disarmed initial position to contact the workpiece, control the one or more motors to move the groove roll from the disarmed initial position to contact the workpiece in response to receiving the selection, measure a distance moved by the groove roll when the groove roll is moved from the disarmed initial position to contact the workpiece, and determine the workpiece dimension based on a difference between the measured distance and the initial distance.

In some aspects, the electronic processor is also configured to compare the workpiece dimension to an expected thickness of the workpiece, and determine that the workpiece is already grooved when the workpiece dimension is smaller than the expected thickness.

In some aspects, the roll groover also includes a limit switch provided on the housing. The electronic processor is configured to detect, using the limit switch, a walk-off of the workpiece.

In some aspects, the electronic processor is also configured to detect, using an inertial measurement unit, movement of the groove roll around the workpiece, determine a profile of the workpiece based on the movement of the groove roll around the workpiece, compare the profile of the workpiece to a predetermined profile, and determine that the workpiece is oblong when the profile of the workpiece deviates from the predetermined profile.

In some aspects, the electronic processor is also configured to detect, using a sensor, an angle of the roll groover compared to the workpiece, and determine that the workpiece is a flared pipe when the detected angle deviates from a predetermined angle.

Some embodiments provide a roll groover including a housing, an inner roller provided on the housing and configured to be received in an inner circumference of a workpiece, a groove roll provided on the housing and configured to produce a groove on the workpiece, one or more motors provided within the housing and configured to drive the groove roll, an electronic processor electrically connected to the one or more motors. The electronic processor is configured to control the one or more motors to move the groove roll around the workpiece while measuring distance, determine whether the groove roll has traveled a first predetermined distance around a circumference of the workpiece, and determine whether the groove roll is below a second predetermined distance of a final depth when the groove roll has traveled the first predetermined distance. In response to the groove roll not being below the second predetermined distance of the final depth, the electronic processor is configured to control the one or more motors to increase groove depth by a predetermined increment. In response to the groove roll being below the second predetermined distance of the final depth, the electronic processor is configured to control the one or more motors to increase groove depth by a fractional increment, control the one or more motors to move the groove roll around the workpiece, determine whether the groove roll is at an initial position, and control the one or more motors to stop and indicate completion of operation when the groove roll is at the initial position.

Some embodiments provide a method of operating a roll groover including an inner roller configured to be received in an inner circumference of a workpiece and a groove roll configured to produce a groove on the workpiece. The method includes operating, using an electronic processor, one or more motors to perform a first operation of moving the groove roll in a radial direction. The first operation is performed to adjust a groove depth on the workpiece. The method also includes operating, using the electronic processor, the one or more motors to perform a second operation of moving the groove roll in a circumferential direction. The second operation is performed to produce the groove on the workpiece.

In some aspects, the method also includes determining, using an inertial measurement unit, a position of the groove roll.

In some aspects, the method also includes controlling the one or more motors to move the groove roll around the workpiece while measuring a distance, and increasing, using the one or more motors, groove depth in predetermined increments for each rotation of the groove roll by a first predetermined distance.

In some aspects, the method also includes providing, using a battery pack, power to the one or more motors.

In some aspects, the method also includes detecting an actuation of an arm/disarm button, controlling the one or more motors to move the groove roll toward the workpiece, detecting, using one or more sensors, a current drawn by the one or more motors, determining whether the current exceeds an arm threshold, controlling the one or more motors to stop when the current exceeds the arm threshold, and providing an indication that the roll groover is armed.

In some aspects, the method also includes detecting actuation of an arm/disarm button, controlling the one or more motors to move the groove roll away from the workpiece, determining whether the groove roll is at a home position, controlling the one or more motors to stop when the groove roll is at the home position, and providing an indication that the roll groover is disarmed.

In some aspects, the method also includes detecting actuation of a jog trigger, controlling the one or more motors to move the groove roll toward the workpiece, and determining whether the jog trigger is still actuated. In response to the jog trigger continued to be activated, the method includes detecting, using one or more sensors, a current drawn by the one or more motors, determining whether the current exceeds an arm threshold, controlling the one or more motors to stop when the current exceeds the arm threshold, and providing an indication that the roll groover is armed In response to the jog trigger not being actuated the method includes controlling the one or more motors to stop.

In some aspects, the method also includes detecting actuation of a run button, determining, using an inertial measurement unit, an initial position of the groove roll, controlling the one or more motors to move the groove roll around the workpiece while measuring distance, determining whether the groove roll has rotated 360°, controlling the one or more motors to stop and record a measured distance when the groove roll has rotated 360°, and determining a groove depth based on the measured distance.

In some aspects, the method also includes controlling the one or more motors to move the groove roll around the workpiece while measuring distance, determining whether the groove roll has traveled a first predetermined distance around a circumference of the workpiece, and determining whether the groove roll is below a second predetermined distance of a final depth when the groove roll has traveled the first predetermined distance. In response to the groove roll not being below the second predetermined distance of the final depth, the method includes controlling the one or more motors to increase groove depth by a predetermined increment. In response to the groove roll being below the second predetermined distance of the final depth, the method includes controlling the one or more motors to increase groove depth by a fractional increment, controlling the one or more motors to move the groove roll around the workpiece, determining whether the groove roll is at an initial position, and controlling the one or more motors to stop and indicate completion of operation when the groove roll is at the initial position.

In some aspects, the method also includes receiving a selection of a single revolution mode, and controlling the one or more motors to complete a single revolution of the groove roll around the workpiece.

In some aspects, the method also includes detecting that the roll groover is stationary, receiving sensor data from one or more light detection and ranging (LiDAR) sensors, generating a base 3D point cloud based on the sensor data, continuing operation of the roll groover, continuously scanning the one or more LiDAR sensors to generate an updated 3D point cloud, comparing the updated 3D point cloud to the base 3D point cloud, and determining whether an abnormal object is detected in the updated 3D point cloud. In response to detecting the abnormal object, the method includes determining whether the abnormal object is within a predetermined distance of the roll groover, and stopping operation of the roll groover when the abnormal object is within the predetermined distance of the roll groover.

In some aspects, the groove roll is a replaceable die and the method includes receiving a selection for measuring n amount of wear on the replaceable die, retrieving an initial distance an unworn replaceable die moves from a disarmed initial position to contact a fixed point, controlling the one or more motors to move the groove roll from the disarmed initial position to the fixed point in response to receiving the selection, measuring a distance moved by the groove roll when the groove roll is moved from the disarmed initial position to contact the fixed point, determining whether the measured distance is greater than the initial distance, generating a first indication that the replaceable die is worn when the measured distance is greater than the initial distance, and generating a second indication that the replaceable die is unworn when the measured distance is not greater than the initial distance.

In some aspects, the method also includes receiving a selection for measuring workpiece dimension, retrieving an initial distance the groove roll moves from a disarmed initial position to contact the workpiece, controlling the one or more motors to move the groove roll from the disarmed initial position to contact the workpiece in response to receiving the selection, measuring a distance moved by the groove roll when the groove roll is moved from the disarmed initial position to contact the workpiece, and determining the workpiece dimension based on a difference between the measured distance and the initial distance.

In some aspects, the method also includes comparing the workpiece dimension to an expected thickness of the workpiece, and determining that the workpiece is already grooved when the workpiece dimension is smaller than the expected thickness.

In some aspects, the method also includes detecting, using a limit switch, a walk-off of the workpiece.

In some aspects, the method also includes detecting, using an inertial measurement unit, movement of the groove roll around the workpiece, determining a profile of the workpiece based on the movement of the groove roll around the workpiece, comparing the profile of the workpiece to a predetermined profile, and determining that the workpiece is oblong when the profile of the workpiece deviates from the predetermined profile.

In some aspects, the method also includes detecting, using a sensor, an angle of the roll groover compared to the workpiece, and determining that the workpiece is a flared pipe when the detected angle deviates from a predetermined angle.

Some embodiments provide a method of operating a roll groover including an inner roller configured to be received in an inner circumference of a workpiece and a groove roll configured to produce a groove on the workpiece. The method includes controlling one or more motors to move the groove roll around the workpiece while measuring distance, determining whether the groove roll has traveled a first predetermined distance around a circumference of the workpiece, and determining whether the groove roll is below a second predetermined distance of a final depth when the groove roll has traveled the first predetermined distance. In response to the groove roll not being below the second predetermined distance of the final depth, the method includes controlling the one or more motors to increase groove depth by a predetermined increment. In response to the groove roll being below the second predetermined distance of the final depth, the method includes controlling the one or more motors to increase groove depth by a fractional increment, controlling the one or more motors to move the groove roll around the workpiece, determining whether the groove roll is at an initial position, and controlling the one or more motors to stop and indicate completion of operation when the groove roll is at the initial position.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers," "computing devices," "controllers," "processors," etc., described in the specification can include one or more processing units, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10%, or more) of an indicated value.

It should be understood that although certain drawings illustrate hardware and software located within particular devices, these depictions are for illustrative purposes only. Functionality described herein as being performed by one component may be performed by multiple components in a distributed manner. Likewise, functionality performed by multiple components may be consolidated and performed by a single component. In some embodiments, the illustrated components may be combined or divided into separate software, firmware and/or hardware. For example, instead of being located within and performed by a single electronic processor, logic and processing may be distributed among multiple electronic processors. Regardless of how they are combined or divided, hardware and software components may be located on the same computing device or may be distributed among different computing devices connected by one or more networks or other suitable communication links. Similarly, a component described as performing particular functionality may also perform additional functionality not described herein. For example, a device or structure that is "configured" in a certain way is configured in at least that way but may also be configured in ways that are not explicitly listed.

Other aspects of the embodiments will become apparent by consideration of the detailed description and accompanying drawings.

DETAILED DESCRIPTION

Figure 1:
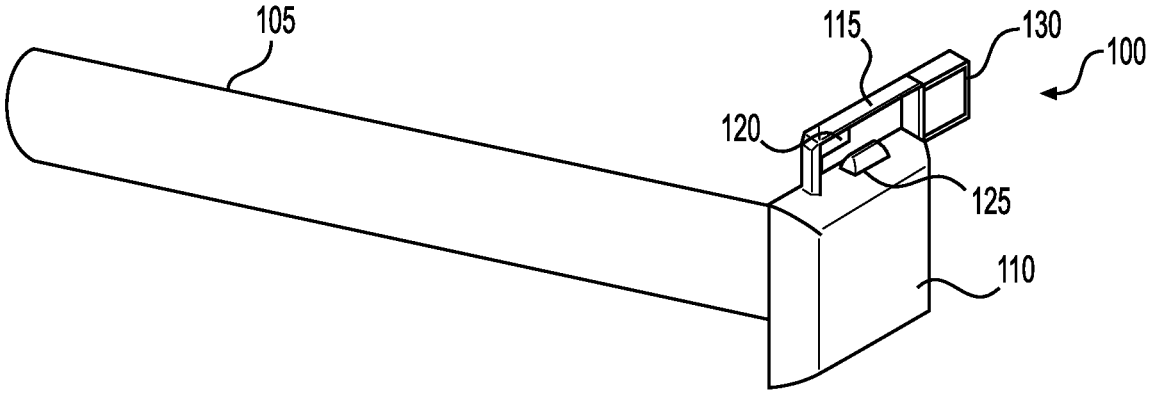
FIG. 1 is a perspective view of roll groover operating on a workpiece in accordance with some embodiments.
Figure 2:
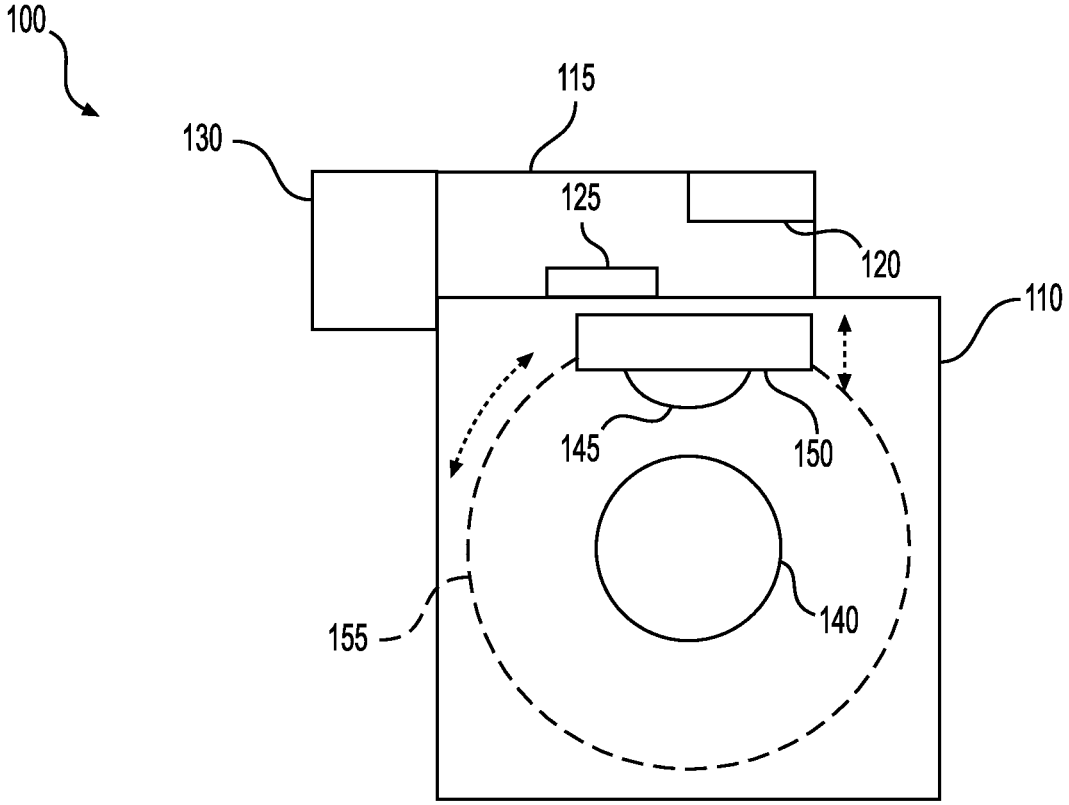
FIG. 2 is a plan view of the roll groover of FIG. 1 in accordance with some embodiments.

FIGS. 1 and 2 illustrate an example embodiment of a roll groover 100. The roll groover 100 is configured to operate on a workpiece 105, for example, a metal pipe, or the like. The roll groover 100 includes a housing 110 and a handle 115 that forms part of the housing. The roll groover 100 also includes a jog trigger 120 and a run switch 125. In some embodiments, the roll groover 100 may include an arm/disarm button 120 in place of or in addition to the jog trigger 120. In the example illustrated, the roll groover 100 is powered by a battery pack 130. The battery pack 130 is, for example, a power tool battery pack having a nominal voltage of 12 V, 18 V, 36 V, 60 V, 80 V, or the like. In some embodiments, the roll groover 100 may be powered by an AC power source and may include a power cord that can be plugged into a wall outlet.

The roll groover 100 includes an inner roller 140 provided around a center of the housing 110. The inner roller 140 is received on the inside of a pipe. The inner roller 140 is dimensioned to fit within the inner circumference of any pipe currently used in the industry for transporting water and steam. A groove roll 145 is provided on a circumferentially outer side of the inner roller 140. The groove roll 145 engages an outer circumference of the workpiece 105 to roll a groove onto the workpiece 105. A roll casing 150 is provided over the groove roll 145 such that the groove roll 145 is mounted and moves with the roll casing 150. The roll casing 150 with the groove roll 145 moves around a track 155. The groove roll 145 produces a groove on the workpiece 105 by moving around the track 155.

Figure 3A:
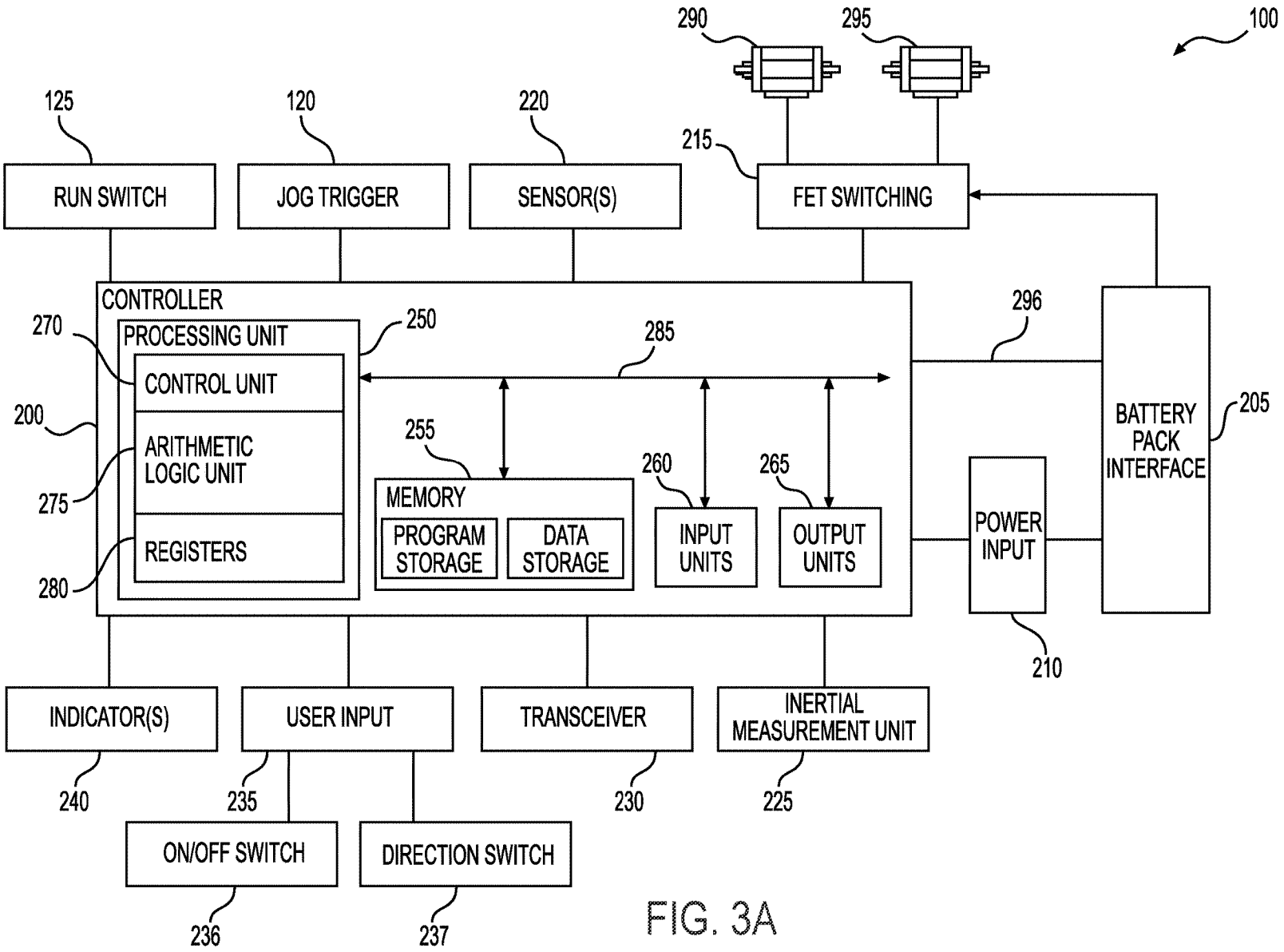
FIG. 3A-3C are block diagrams of the roll groover of FIG. 1 in accordance with some embodiments.

FIG. 3A illustrates a block diagram of the roll groover 100. In the example illustrated, the roll groover 100 includes a controller (for example, an electronic processor 200) electrically and/or communicatively connected to a variety of modules or components of the roll groover 100. For example, the illustrated electronic processor 200 is connected to a battery pack interface 205, a power input module 210, a FET switching module 215, one or more sensors 220, a transceiver 230, a user input module 235, one or more indicators 240, the jog trigger 120 (or the arm/disarm button 120), and the run switch 125. The electronic processor 200 includes combinations of hardware and software that are operable to, among other things, control operation of the roll groover 100, activate one or more indicators 240, monitor the operation of the roll groover 100, communicate with an associated external device (e.g., a smartphone) and the like.

In some embodiments, the electronic processor 200 includes a plurality of electrical and electronic components that provide power, operational control, and protection to the components and modules within the electronic processor 200 and/or the roll groover 100. For example, the electronic processor 200 includes, among other things, a processing unit 250 (e.g., a microprocessor, a microcontroller, an electronic processor, or another suitable programmable device), a memory 255, input units 260, and output units 265. The processing unit 250 includes, among other things, a control unit 270, an arithmetic logic unit ("ALU") 275, and a plurality of registers 280 (shows as a group of registers in FIG. 3A), and is implemented using a known computer architecture, such as a modified Harvard architecture, a von Neumann architecture, etc. The processing unit 250, the memory 255, the input units 260, and the output units 265 as well as the various modules connected to the electronic processor 200 are connected by one or more control and/or data buses (e.g., a common bus 285). The control and/or data buses are shown generally in FIG. 3A for illustrative purposes. The use of one or more control and/or data buses for the interconnection between and communication among the various modules and components would be known to a person skilled in the art in view of the invention described herein.

The memory 255 is a non-transitory computer readable medium and includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the roll groover 100 can be stored in the memory 255 of the electronic processor 200. The software includes, for example, firmware, one or more applications, program data, filters, rules, one or more program modules, and other executable instructions. The electronic processor 200 is configured to retrieve from memory and execute, among other things, instructions related to the control processes and methods described herein. In other constructions, the electronic processor 200 includes additional, fewer, or different components.

The battery pack interface 205 includes a combination of mechanical and electrical components configured to and operable for interfacing with the battery pack 130. For example, power provided by the battery pack 130 to the roll groover 100, is provided through the battery pack interface to a power input module 210. The power input module 210 includes combinations of active and passive components to regulate or control the power received from the battery pack 130 prior to power being provided to the electronic processor 200. The battery pack interface 205 also supplies power to the FET switching module 215 to be switched by switching FETs in the FET switching module 215 to selectively provide power to a first motor 290 and a second motor 295. In some embodiments, the roll groover includes multiple independent FET switching bridges (e.g., including six FETs) in the FET switching module 215. The battery pack interface 205 also includes, for example, a communication line 296 for providing a communication line or link between the electronic processor 200 and the battery pack 130.

The first motor 290 and the second motor 295 are, for example, brushless direct current (BLDC) motors. The first motor 290 is operated to move the groove roll 145 radially inward and outward. The first motor 290 is controlled by the user using the jog trigger 120 (or arm/disarm button 120). The jog trigger 120 may be implemented as a trigger switch, a push button, a knob, or the like. When the user actuates the jog trigger 120, the electronic processor 200 controls the FET switching module 215 to move the groove roll 145 radially inward or radially outward. The first motor 290 is coupled to the groove roll 145 using, for example, a feedscrew. The first motor 290 drives the feedscrew to produce movement in the groove roll 145. The FET switching module 215 includes a first H-bridge or a first inverter bridge used for controlling the first motor 290. The electronic processor 200 provides PWM signals to the first H-bridge or the first inverter bridge to control the speed and direction of the first motor 290 based on signals received from the jog trigger 120 and a first rotary encoder 310 (shown in FIG. 3B). The direction of movement, that is, radially inward or radially outward, may be selected using a direction switch provided separately from the jog trigger 120. When the groove roll 145 is moved radially inward toward the inner roller 140, the groove roll 145 engages the workpiece 105 to bite into the workpiece 105. The jog trigger 120 may be operated until the groove roll 145 engages the workpiece as further described below with respect to FIGS. 6 and 8. When the groove roll 145 is moved radially outward away from the inner roller 140, the groove roll 145 disengages the workpiece 105 such that the roll groover 100 can be removed from the workpiece 105. In some embodiments, the first motor 290 moves the inner roller 140 rather than the groove roll 145.

The second motor 295 is operated to move the roll casing 150 and the groove roll 145 circumferentially around the workpiece 105 to generate the groove in the workpiece 105. That is, the roll groover 100 or a portion of the roll groover 100 (e.g., the groove roll 145) moves around the pipe rather than the pipe turning within the tool. The second motor 245 is controlled by the user using the run switch 125. The run switch 125 may be implemented as a trigger switch, a push button, a knob, or the like. When the user actuates the run switch 125, the electronic processor 200 controls the FET switching module 215 to move the roll casing 150 and the groove roll 145 around the track 155. The FET switching module 215 includes a second H-bridge or a second inverter bridge used for controlling the second motor 295. The controller 200 provides PWM signals to the second H-bridge or the second inverter bridge to control the speed and direction of the second motor 295 based on the signals received from the run switch 125 and a second rotary encoder 320 (shown in FIG. 3B). The direction of movement, that is, clockwise or anti-clockwise, may be selected using a direction switch provided separately from the run switch 125. The second motor 295 may move the roll casing 150 and the groove roll 145 in either direction to produce the groove in the workpiece 105. In some embodiments, a single motor rather than the first motor 290 and the second motor 295 may be used to control both the radial movement and the circumferential movement of the groove roll 145. This can be achieved by using mechanical gears and clutching to shift the operation of the single motor between the different movements.

In some embodiments, several of the electrical components of the roll groover 100 are provided on one or more circuit boards. The circuit boards may, for example, be associated with the motors 290, 295, the jog trigger 120, the run switch 125, the on/off button 236, the direction switch 237, and the battery pack interface 205. The one or more circuit board include a total surface area less than 155 squared centimeters ($cm^2$) (24 $in^2$). Specifically, the total surface are covered by the one or more circuit board includes electronic components for control of two motors 290, 295.

Figure 3B:
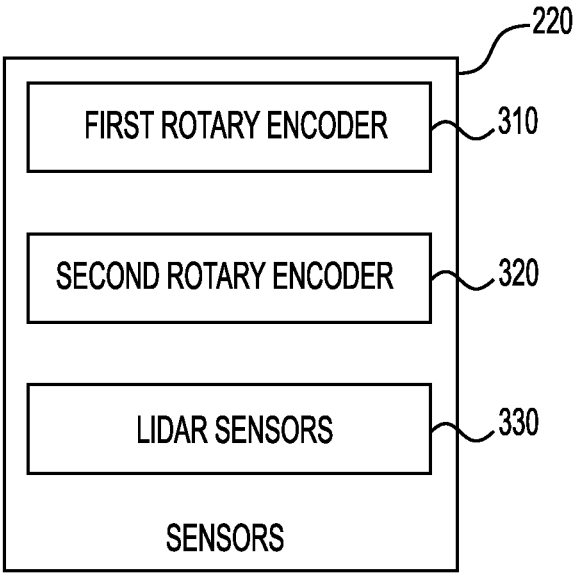

Referring to FIG. 3B, the one or more sensors 220 includes a first rotary encoder 310, a second rotary encoder 320, and a plurality of LiDAR (light detection and ranging) sensors 330. The first rotary encoder 310 and the second rotary encoder 320 are, for example, hall-effect sensors. The first rotary encoder 310 is provided on the first motor 290 to detect a rotary position of the first motor 290. The first rotary encoder 310 includes, for example, three Hall-effect sensors placed 120 degrees apart. The first rotary encoder 310 divides the motor into six sectors (for example, 0-60°, 60-120°, 120-180°, 180-240°, 240-300°, 300-360°). A full mechanical rotation of the rotor includes movement of the rotor through these six sectors twice. Specifically, power flows through the six sectors to produce a force on the rotor to rotate the rotor within a stator. Thus, the rotary position of the rotor of the first motor 290 can be accurately sensed for every $12^{th}$ of the circumference of the rotor. Addition Hall-effect sensors may be used to provide more granular measurements. Through the coupling of the rotor to a gearcase and a feedscrew, a linear equation directly ties the rotation of the rotor to the linear movement of the feedscrew. The rotary position of the motor and the linear equation can be used to accurately detect the linear position of the groove roll 145 and produce incremental movement of the groove roll 145.

The second rotary encoder 320 is provided on the second motor 295 to detect a rotary position of the second motor 295. The second rotary encoder 320 includes, for example, three Hall-effect sensors placed 120 degrees apart. The second rotary encoder 320 divides the motor into six sectors (for example, 0-60°, 60-120°, 120-180°, 180-240°, 240-300°, 300-360°). A full mechanical rotation of the rotor includes movement of the rotor through these six sectors twice. Specifically, power flows through the six sectors to produce a force on the rotor to rotate the rotor within a stator. Thus, the rotary position of the rotor of the second motor 295 can be accurately sensed for every $12^{th}$ of the circumference of the rotor. Additional Hall-effect sensors may be used to provide more granular measurements. Through the coupling of the rotor to a gearcase and the groove roll 145, a linear equation directly ties the rotation of the rotor to the rotational movement of the groove roll 145 around the track 155. The rotary position of the motor and the linear equation can be used to accurately detect the rotational position of the groove roll 145 and produce movement of the groove roll 145 around the circumferential track 155.

The plurality of LiDAR sensors 330 are used to detect objects in the vicinity of the roll groover 100. During automated operation of the roll groover 100, the LiDAR sensors 330 may be used to detect obstructions or objects in the vicinity of the roll groover 100. An example method for detecting objects in the vicinity of the roll groover 100 is explained below with respect to FIG. 11. The one or more sensors 220 may include additional sensors, for example, a current sensor, a voltage sensor, and the like.

Figure 3C:
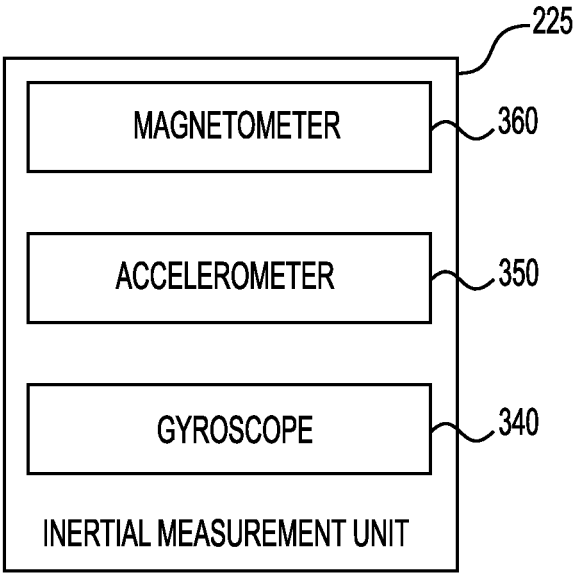

The inertial measurement unit 225 is operably coupled to the electronic processor 200 to, for example, provide heading, orientation, location, and movement information of the roll groover 100 to the electronic processor 200. Referring to FIG. 3C, the inertial measurement unit 225 includes, for example, a 9-axis inertial measurement sensor including a gyroscope 340, an accelerometer 350, and a magnetometer 360. The gyroscope 340 provides an orientation of the roll groover 100, the accelerometer 350 provides an angular position/velocity and a gravitational pull acceleration of the roll groover 100, and the magnetometer 360 provides a heading of the roll groover 100. The electronic processor 200 uses the information received from the inertial measurement unit 225 to determine a position and/or orientation of the roll groover 100. A method for determining the position of the roll groover 100 is explained below with respect to FIG. 5.

Referring back to FIG. 3A, the transceiver 230 is operably coupled to the electronic processor 200 to, for example, allow wired and/or wireless communication with an external device 400 (shown in FIG. 4) (e.g., a user's smartphone, a connected display or control unit, and the like). The transceiver 230 allows the electronic processor 200 to receive inputs from the external device and provide outputs for display on the external device. In some embodiments, the jog trigger 120, the run switch 125, the indicators 240, and the user input module 235 may be implemented as inputs and/or outputs on the external device. The inputs from the external device 400 are received through the transceiver 230 and the outputs to the external device 400 are provided through the transceiver 230.

The user input module 235 is operably coupled to the electronic processor 200 to, for example, select a direction of operation, a torque, and/or speed setting of the first motor 290 and/or the second motor 295. For example, the user input module 235 includes an ON/OFF switch 236 to turn the roll groover 100 on or off and a direction switch 237 to select a direction of rotation of the groove roll 145. In some embodiments, the user input module 235 includes a combination of digital and analog input or output devices required to achieve a desired level of operation for the roll groover 100, such as one or more knobs, one or more dials, one or more switches, one or more buttons, a touch screen, etc. In some embodiments, the jog trigger 120 and the run switch 125 are part of the user input module 235. The indicators 240 include, for example, one or more light-emitting diodes ("LED"). The indicators 240 can be configured to display conditions of, or information associated with the roll groover 100. For example, the indicators 240 are configured to indicate that the groove roll 145 has reached a selected depth, the roll grooving operation is complete, and the like. In some embodiments, the indicators 240 may be part of a connected display or may be provided in an external device.

Figure 4:
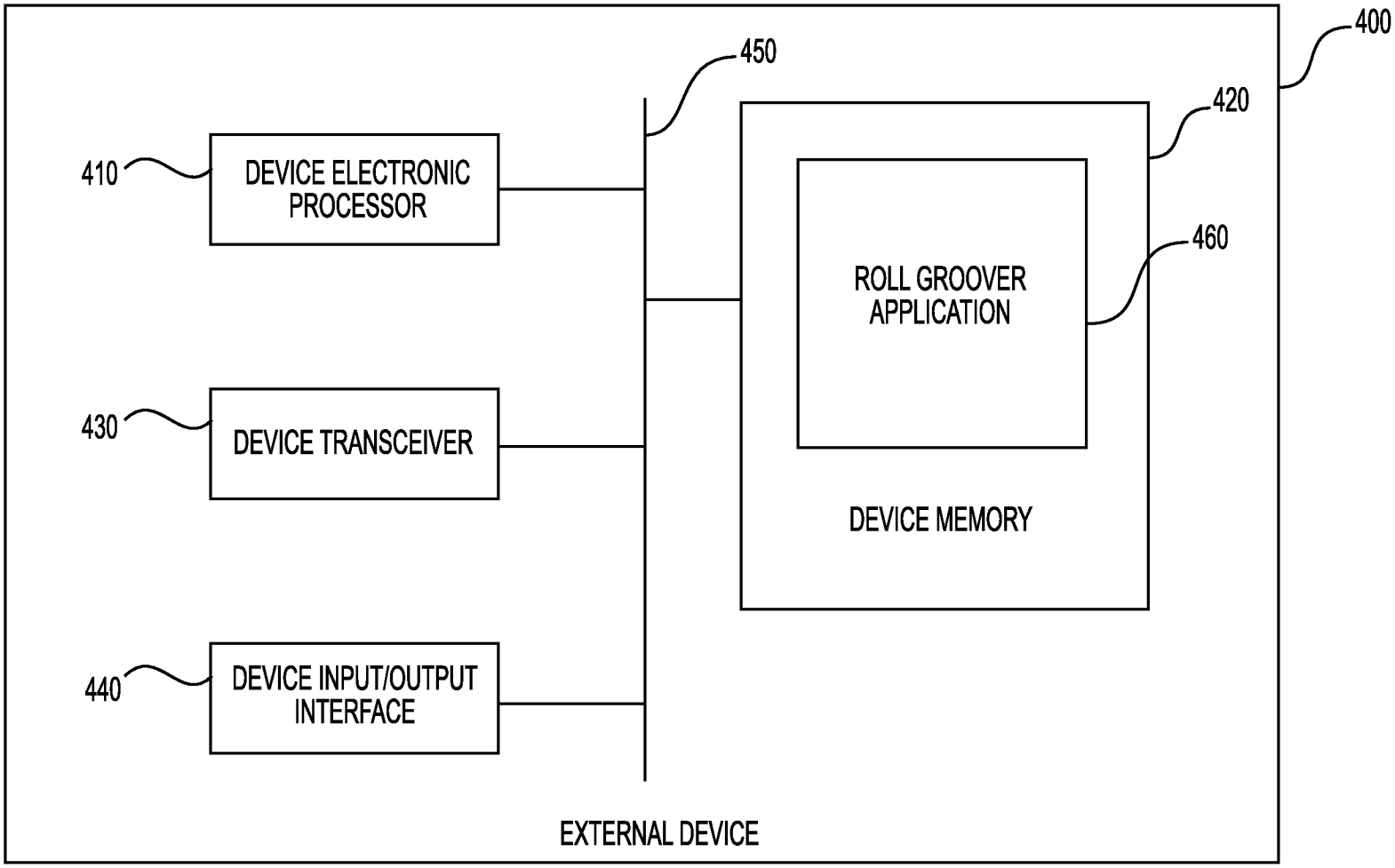
FIG. 4 is a block diagram of an external device communicating with the roll groover of FIG. 1 in accordance with some embodiments.

FIG. 4 illustrates a block diagram of an example embodiment of an external device 300 communicating with the roll groover 100. The external device 400 is, for example, a smart telephone, a smart wearable device, a tablet computer, a laptop computer, a remote control unit, and the like. In the example illustrated, the external device 400 includes a device electronic processor 410, a device memory 420, a device transceiver 430, and a device input/output interface 440. The device electronic processor 410, the device memory 420, the device transceiver 430, and the device input/output interface 440 communicate over one or more control and/or data buses (e.g., device communication bus 450). The device electronic processor 410 and the device memory 420 are implemented similar to the processing unit 250 and the memory 255, respectively. The device memory 420 stores a roll groover application 460 that is executed by the device electronic processor 410 to perform functions of the external device 400 described herein.

The device transceiver 430 allows for wired or wireless communication with the roll groover 100. The device transceiver 430 may include separate receiving and transmitting components, for example, a receive and a transmitter. The device input/output interface 440 includes one or more input units (e.g., a mouse, a keyboard, a touch pad, and the like), one or more output units (e.g., a display, a speaker, indicators, and the like), and/or combination input/output units (e.g., a touch screen). The device input/output interface 440 may generate a graphical user interface (GUI) on a display of the external device 400 to receive various inputs (e.g., jog trigger, run switch, direction of motors, and the like) and to display various outputs (e.g., job completion, error warnings, and the like).

Figure 5:
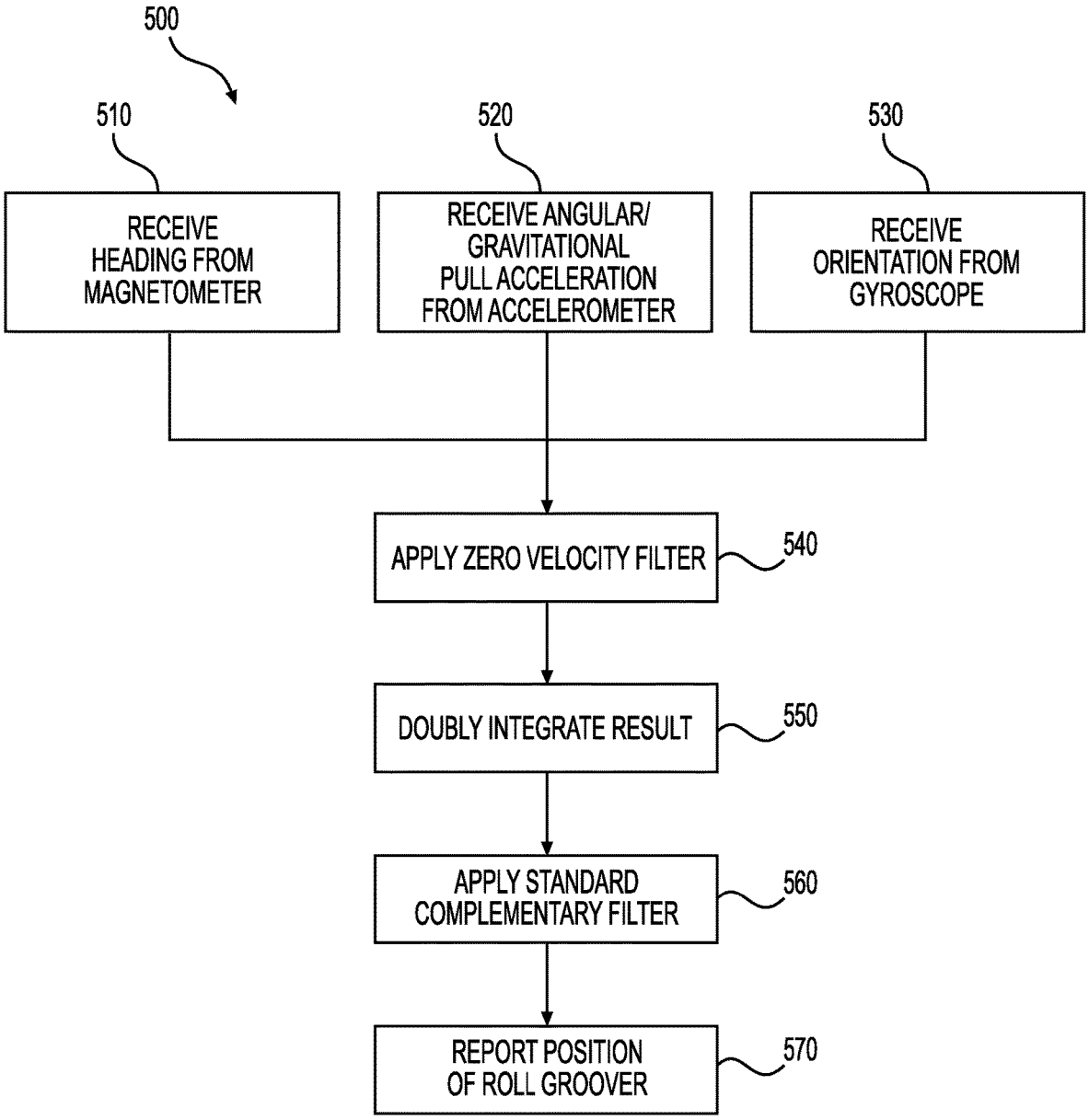
FIG. 5 is a flowchart of a method for detecting a position of the roll groover of FIG. 1 in accordance with some embodiments.

FIG. 5 is a flowchart of an example method 500 for determining a position of the roll groover 100. The method 500 includes receiving, at the electronic processor, a heading of the roll groover 100 from the magnetometer 360 (at block 510), an angular or gravitational pull acceleration from the accelerometer 350 (at block 520), and an orientation from the gyroscope 340 (at block 530). The electronic processor 200 receives the heading, the angular or gravitational pull acceleration, and the orientation from the inertial measurement unit 225.

The method 500 also includes applying, using the electronic processor 200, a zero velocity filter (at block 540). The zero velocity filter removes any interfering signals between the inputs. The method 500 includes doubly integrating, using the electronic processor 200, the result (at block 550) after applying the zero velocity filter. Doubly integrating the result provides an estimated position of the roll groover 100. The method 500 includes applying, using the electronic processor 200, a standard complementary filter (at block 560). Over time, error may build up in the sensor readings. The standard complementary filter corrects the error to improve the accuracy of the sensor readings. The method 500 includes reporting, using the electronic processor, the position of the roll groover 100 (at block 570). The roll groover 100 position is used for operation of the roll groover 100 as described below with respect to FIG. 9.

Figure 6:
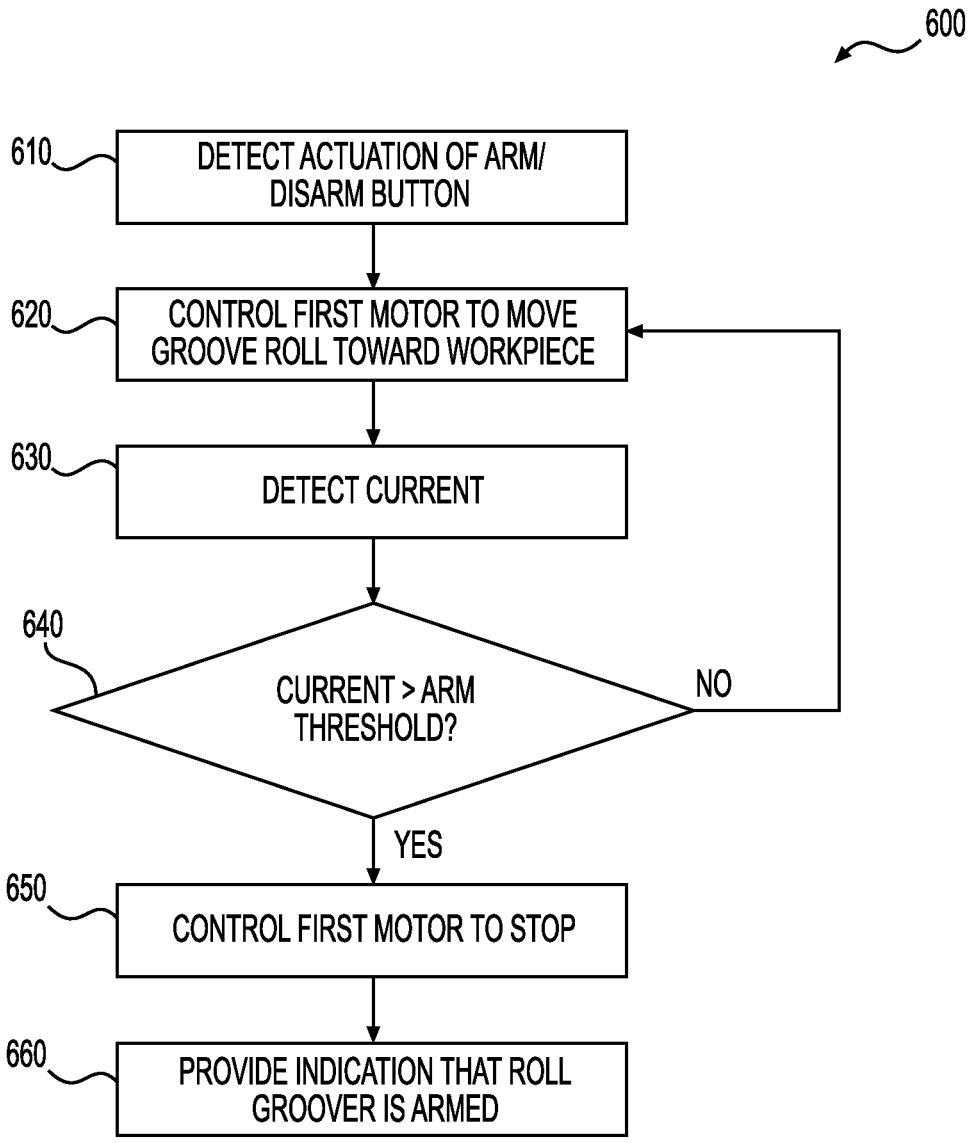
FIG. 6 is a flowchart of a method for arming the roll groover of FIG. 1 in accordance with some embodiments.

FIG. 6 is a flowchart of an example method 600 for arming the roll groover 100. The method 600 includes detecting, using the electronic processor 200, actuation of the arm/disarm button 120 (at block 610). The user places the roll groover 100 on the workpiece 105 (for example, a metal pipe). The roll groover 100 is placed such that the inner roller 140 is received in the inner circumference of the pipe. The inner roller 140 supports the roll groover 100 on the workpiece 105. The user may then actuate the arm/disarm button 120 to arm the roll groover 100 onto the workpiece 105. The arm/disarm button 120 may be provided on the housing of the roll groover 100, on a connected display, or the external device 400.

The method 600 includes controlling, using the electronic processor 200, the first motor 290 to move the groove roll 145 toward the workpiece 105 (at block 620). The electronic processor 200 controls the first motor 290 using the FET switching module 215. The first motor 290 is controlled to move the groove roll 145 towards the inner roller 140. In some embodiments, the first motor 290 is used to move the inner roller 140 rather than the groove roll 145 to move the groove roll 145 toward the workpiece 105.

The method 600 includes detecting, using the one or more sensors 220, a current drawn by the first motor 290 (at block 630). The one or more sensors 220 may include, for example, a current sensor that detects an amount of current flowing to the first motor 290. The current sensor provides a signal indicating the amount of current drawn by the first motor 290 to the electronic processor 200.

The method 600 includes determining, using the electronic processor 200, whether the current exceeds an arm threshold of the roll groover 100 (at block 640). During operation of the first motor 290, the current flow is typically constant when the groove roll 145 does not encounter resistance. When the groove roll 145 contacts the workpiece 105, the current drawn by the first motor 290 starts increasing. An accumulator may be used to accumulate the current signals and detect a sudden increase in current. The electronic processor 200 determines that the groove roll 145 has contacted the workpiece 105 when the current accumulator reaches the predetermined arm threshold value.

The electronic processor 200 continues operation of the first motor 290 when the current does not exceed the arm threshold. When the current exceeds the arm threshold, the method 600 includes controlling, using the electronic processor 200, the first motor 290 to stop (at block 650). The electronic processor 200 controls the first motor 290 using the FET switching module 215. The method 600 includes providing, using the electronic processor 200, an indication that the roll groover 100 is armed (at block 660). The electronic processor 200 activates an indicator 240 (for example, an LED) to inform the user that the roll groover 100 is armed. Once the roll groover 100 is armed, the roll groover 100 can support itself on the workpiece 105. The user may then remove their hand(s) from the roll groover 100.

Figure 7:
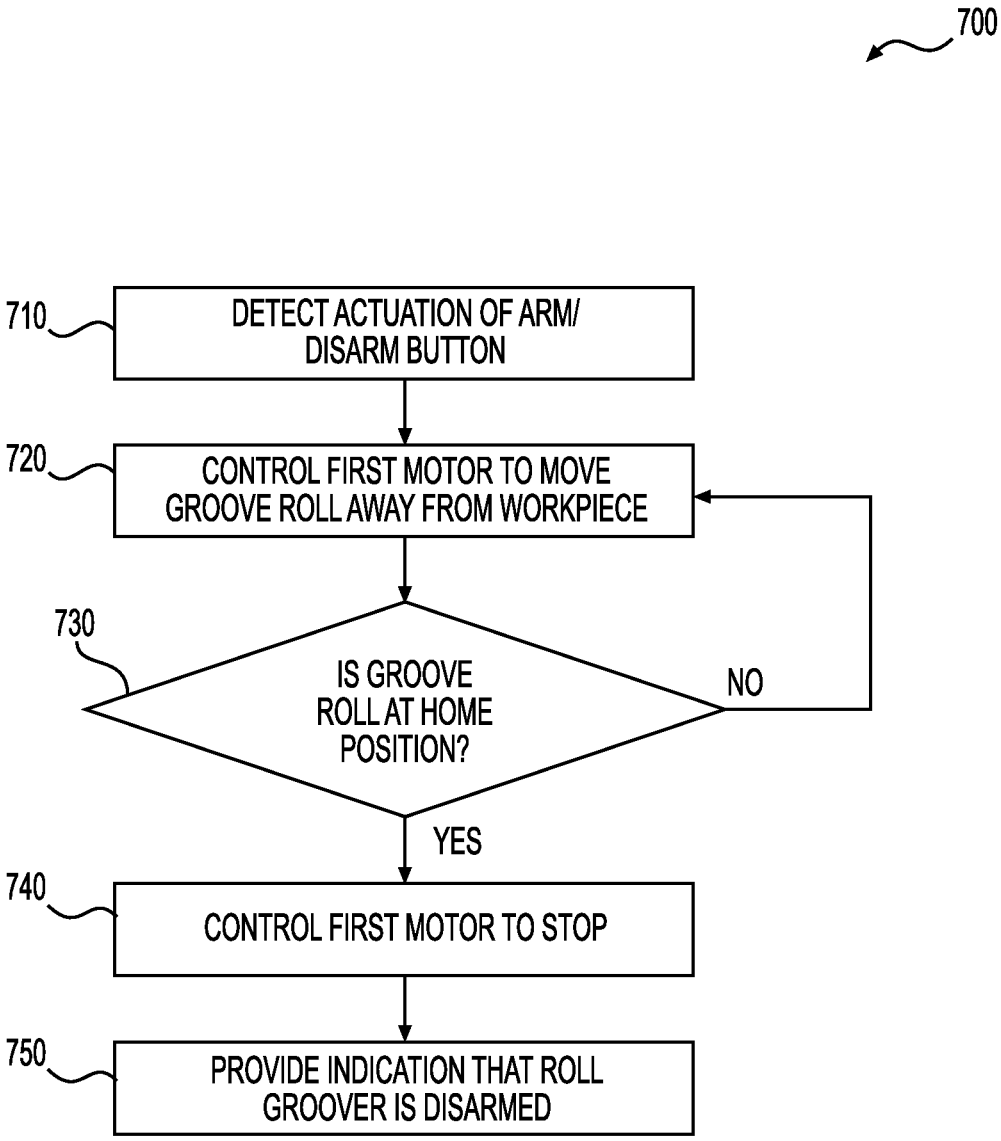
FIG. 7 is a flowchart of a method for disarming the roll groover of FIG. 1 in accordance with some embodiments.

FIG. 7 is a flowchart of an example method 700 for disarming the roll groover 100. The method 700 includes detecting, using the electronic processor 200, actuation of the arm/disarm button 120 (at block 710). Once the roll groover 100 has completed grooving the workpiece 105, the user can disarm the roll groover 100 from the workpiece 105. The user may actuate the arm/disarm button 120 to disarm the roll groover 100 from the workpiece 105. The arm/disarm button 120 may be provided on the housing of the roll groover 100, on a connected display, or an external device 400.

The method 700 includes controlling, using the electronic processor 200, the first motor 290 to move the groove roll 145 away from the workpiece 105 (at block 720). The electronic processor 200 controls the first motor 290 using the FET switching module 215. The first motor 290 is controlled to move the groove roll 145 away from the inner roller 140. In some embodiments, the first motor 290 is used to move the inner roller 140 rather than the groove roll 145 to move the groove roll 145 away from the workpiece 105.

The method 700 includes determining, using the electronic processor 200, whether the groove roll 145 is at a home position (at block 730). The home position may include, for example an extremity of the feedscrew. An optical sensor or other sensor may be used to detect that the groove roll 145 is at a home position. In some embodiments, the electronic processor 200 may also use a current accumulator as described above to determine that the groove roll 145 is at the home position. The electronic processor 200 continues to operate the first motor 290 until the groove roll 145 reaches the home position.

When the groove roll 145 is at the home position, the method 700 includes controlling, using the electronic processor 200, the first motor 290 to stop (at block 740). The electronic processor 200 controls the first motor 290 using the FET switching module 215. The method 700 includes providing, using the electronic processor 200, an indication that the roll groover 100 is disarmed (at block 750). The electronic processor 200 activates an indicator 240 (for example, an LED) to inform the user that the roll groover 100 is disarmed. Once the roll groover 100 is disarmed, the roll groover 100 can be removed from the workpiece 105.

Figure 8:
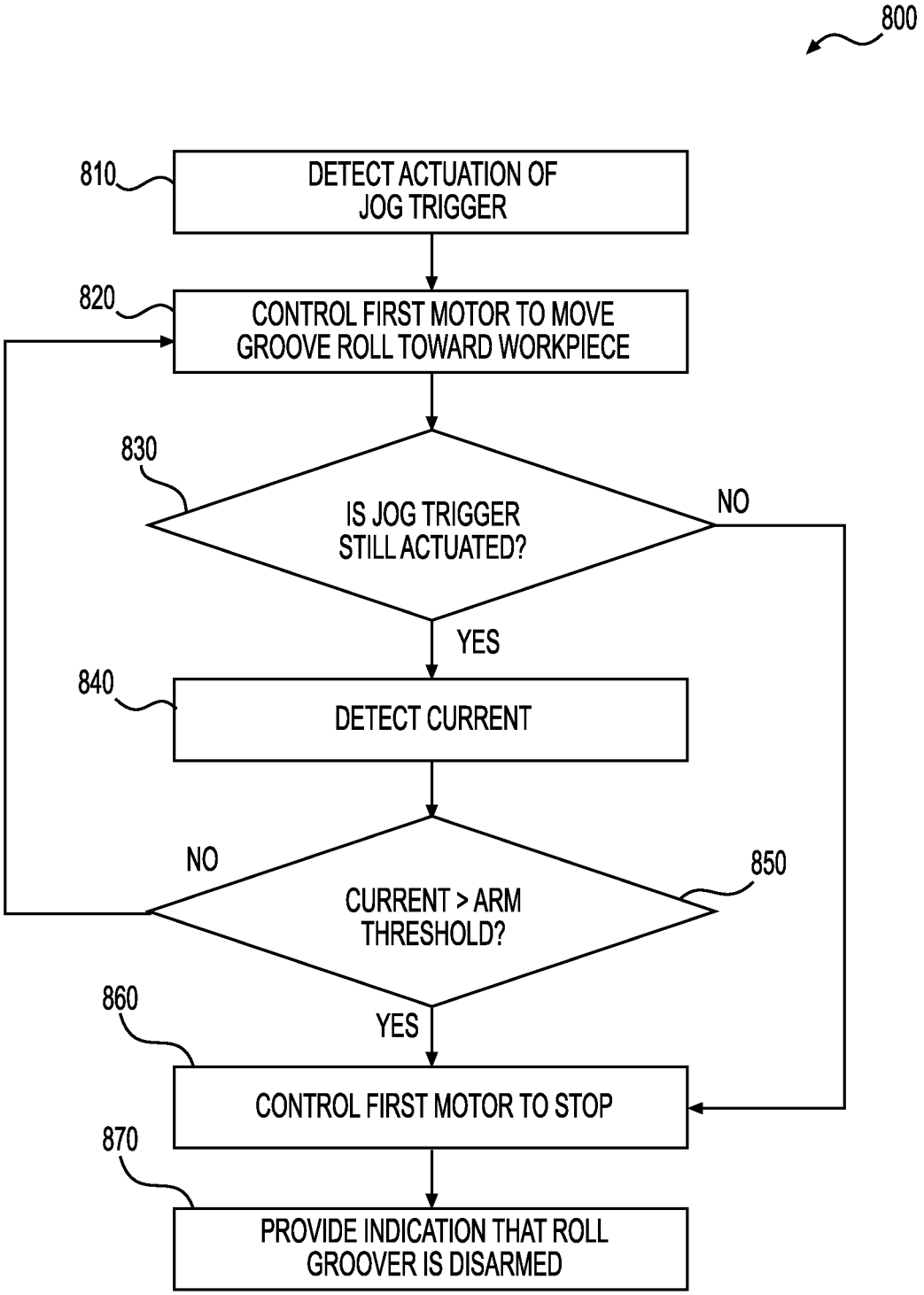
FIG. 8 is a flowchart of a method for arming the roll groover of FIG. 1 in accordance with some embodiments.

In some embodiments, the roll groover 100 may include a jog trigger 120 rather than an arm/disarm button 120 to manually operate the groove roll. FIG. 8 is a flowchart of an example method 800 for arming the roll groover 100 using the jog trigger 120. The method 600 includes detecting, using the electronic processor 200, actuation of the jog trigger 120 (at block 810). The user places the roll groover 100 on the workpiece 105 (e.g., a pipe). The roll groover 100 is placed such that the inner roller 140 is received in the inner circumference of the pipe. The inner roller 140 supports the roll groover 100 on the workpiece 105. The user may then actuate the jog trigger 120 to arm the roll groover 100 onto the workpiece 105. The jog trigger 120 may be provided on the housing of the roll groover 100, on a connected display, or the external device 400.

The method 800 includes controlling, using the electronic processor 200, the first motor 290 to move the groove roll 145 toward the workpiece 105 (at block 820). The electronic processor 200 controls the first motor 290 using the FET switching module 215. The first motor 290 is controlled to move the groove roll 145 towards the inner roller 140. In some embodiments, the first motor 290 is used to move the inner roller 140 rather than the groove roll 145 to move the groove roll 145 toward the workpiece 105.

The method 800 includes determining, using the electronic processor 200, whether the jog trigger 120 is still actuated (at block 830). The electronic processor 200 continues to operate the first motor 290 while the jog trigger 120 is actuated. When the jog trigger 120 is continued to be actuated, the method 800 includes detecting, using the one or more sensors 220, a current drawn by the first motor 290 (at block 840). The one or more sensors 220 may include, for example, a current sensor that detects an amount of current flowing to the first motor 290. The current sensor provides a signal indicating the amount of current drawn by the first motor 290 to the electronic processor 200.

The method 800 includes determining, using the electronic processor 200, whether the current exceeds an arm threshold of the roll groover 100 (at block 850). During operation the first motor 290, the current flow is typically constant where the groove roll 145 does not encounter resistance. When the groove roll 145 contacts the workpiece 105, the current drawn by the first motor 290 starts increasing. An accumulator may be used to accumulate the current signal and detect a sudden increase in current. The electronic processor 200 determines that the groove roll 145 has contacted the workpiece 105 when the current accumulator reaches the predetermined arm threshold value.

The electronic processor 200 continues operation of the first motor 290 when the current does not exceed the arm threshold. When the current exceeds the arm threshold and/or when the electronic processor 200 determines that the jog trigger 120 is not actuated, the method 800 includes controlling, using the electronic processor 200, the first motor 290 to stop (at block 860). The electronic processor 200 controls the first motor 290 to stop using the FET switching module 215. The method 800 includes providing, using the electronic processor 200, an indication that the roll groover 100 is armed (at block 870). The electronic processor 200 activates an indicator 240 (for example, an LED) to inform the user that the roll groover 100 is armed. Once the roll groover 100 is armed, the roll groover 100 can support itself on the workpiece 105. The user may then remove their hand from the roll groover 100.

Figure 9:
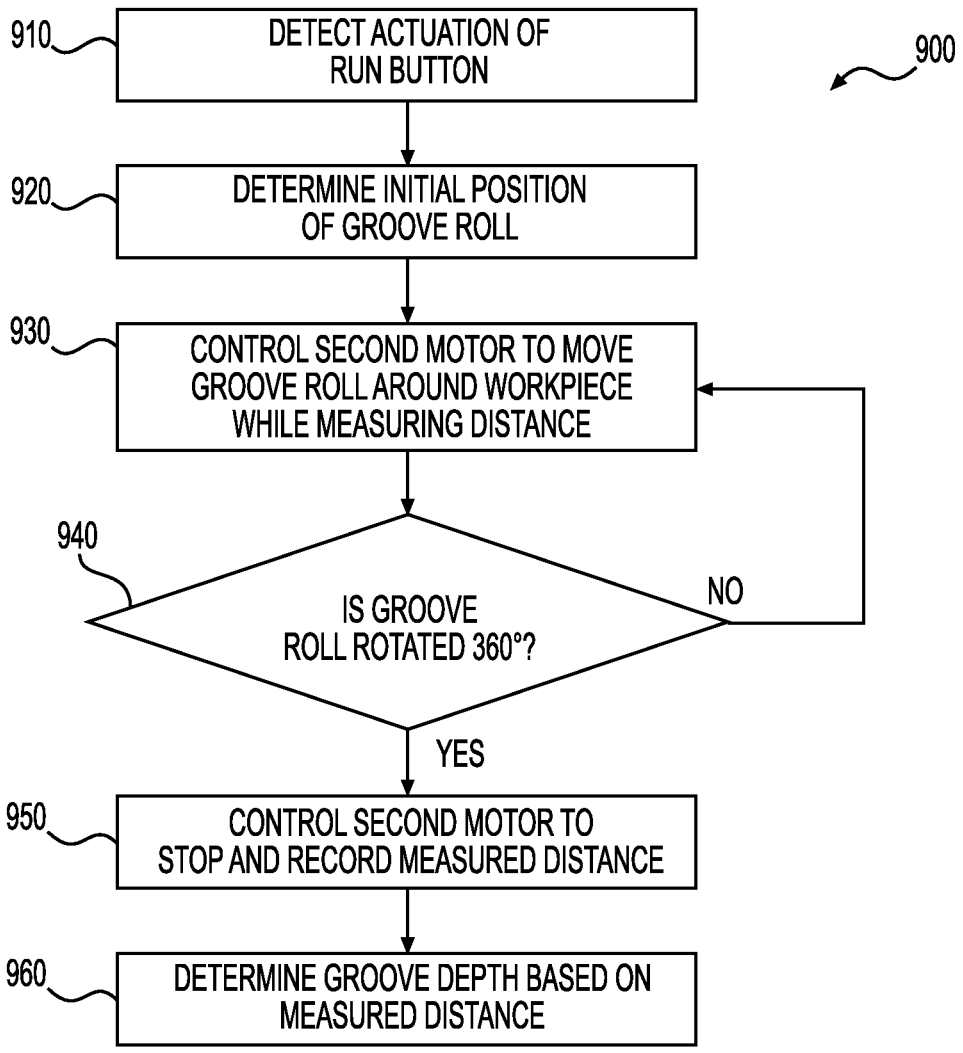
FIG. 9 is a flowchart of a method for determining groove depth of a workpiece using the roll groover of FIG. 1 in accordance with some embodiments.

As discussed above, the roll groover 100 may be armed using an arm/disarm button 120 or a jog trigger 120. Once the roll groover 100 is armed, the roll groover 100 can automatically detect dimensions of the workpiece 105 and the corresponding groove depth. FIG. 9 is a flowchart of an example method 900 for determining groove depth of the workpiece 105. The method 900 includes detecting, using the electronic processor 200, actuation of the run button 125 (at block 910). Once the user receives an indication that the roll groover 100 is armed on the workpiece 105, the user can actuate the run button 125 to start the grooving process by the roll groover 100. The run button 125 may be provided on the housing 110 of the roll groover 100, on a connected display, or the external device 400.

The method 900 includes determining, using the inertial measurement unit 225, an initial position of the groove roll 145 (at block 920). The initial position of the groove roll provides a home position for measuring an outer circumference of the workpiece 105. The initial position can be determined using, for example, the method 500 for determining a position of the roll groover 100. Specifically, the inertial measurement unit 225 includes a 9-axis sensor to provide a home position of the groove roll 145.

The method 900 includes controlling, using the electronic processor 200, the second motor 295, to move the groove roll 145 around the workpiece 105 while measuring distance (at block 930). The electronic processor 200 controls the second motor 295 using the FET switching module 215. The second motor 295 is controlled to move the groove roll 145 around the track 155 and the workpiece 105. In some embodiments, the distance is measured using the inertial measurement unit 225 based on the difference between the initial position (e.g., home position) and intermediate positions of the groove roll 145 as further explained below. In some embodiments, the second rotary encoder 320 is used to measure the distance. As explained above, a linear equation may be derived based on the connection between the second motor 295 and the groove roll 145. The distance traveled can then be calculated using the signals from the second rotary encoder 320 and the linear equation.

The method 900 includes determining, using the electronic processor 200, whether the groove roll 145 has rotated 360° (at block 940). For example, the electronic processor 200 may use the inertial measurement unit 225 to detect whether the groove roll 145 is back at the home position after being operated around the circumference of the workpiece 105. The electronic processor 200 may also use the second rotary encoder 320 to determine the position of the rotor of the second motor 295 to determine whether the groove roll has been rotated 360° around the workpiece 105. The electronic processor 200 continues rotation of the second motor 295 until the second motor 295 has reached the home position after being rotated around the workpiece 105.

When the groove roll 145 has rotated 360°, the method 900 includes controlling, using the electronic processor 200, the second motor 295 to stop and record a measured distance (at block 950). The electronic processor 200 controls the second motor 295 to stop using the FET switching module 215. The measured distance is then recorded in, for example, the memory 255. In one example, the distance is measured using the inertial measurement unit 225. The electronic processor 200 may determine the initial position and a position that was farthest from the initial position during movement of the groove roll 145 around the workpiece 105. The electronic processor 200 determines the difference between the initial position and the farthest position as the diameter and can determine the circumference of the workpiece 105 using the diameter. Alternatively, the electronic processor 200 may detect the circumference using the inertial measurement unit 225 and the second rotary encoder 320. The electronic processor determines the change in angular position of the rotor during the movement of the groove roll 145 around the workpiece 105 from the home position back to the home position. A linear equation previously derived based on the connection between the second motor 295 and the groove roll can be used to determine the circumference of the workpiece 105. The circumference can then be used to determine the diameter and other dimensions of the workpiece. The diameter and/or the circumference of the workpiece can then be recorded in the memory 255 as the measured distance. Specifically, the dimeter may be recorded as the "C" dimension of the workpiece 105

The method 900 includes determining, using the electronic processor 200, a groove depth based on the measured distance (at block 960). Groove depths vary based on the "C" dimension of the pipe in the pipe fitting industry. Typically, a groove depth is standard for a particular "C" dimension of a pipe. The memory 255 stores a look-up table including a mapping between the "C" dimension and the groove depth. The electronic processor 200 can refer the look-up table stored in the memory 255 to determine whether the measured distance (for example, the "C" dimension) is provided in the look-up table. When the measured distance is provided in the look-up table, the electronic processor 200 uses the corresponding groove depth as the groove depth for operation on the workpiece 105. When the measured distance is not provided in the look-up table, the electronic processor 200 may use an industry standard formula to determine the groove depth based on the "C" dimension. The determined groove depth is subsequently used to produce the groove in the workpiece 105. In some embodiments, the groove depth may also be provided as an input on the external device 400.

Figure 10:
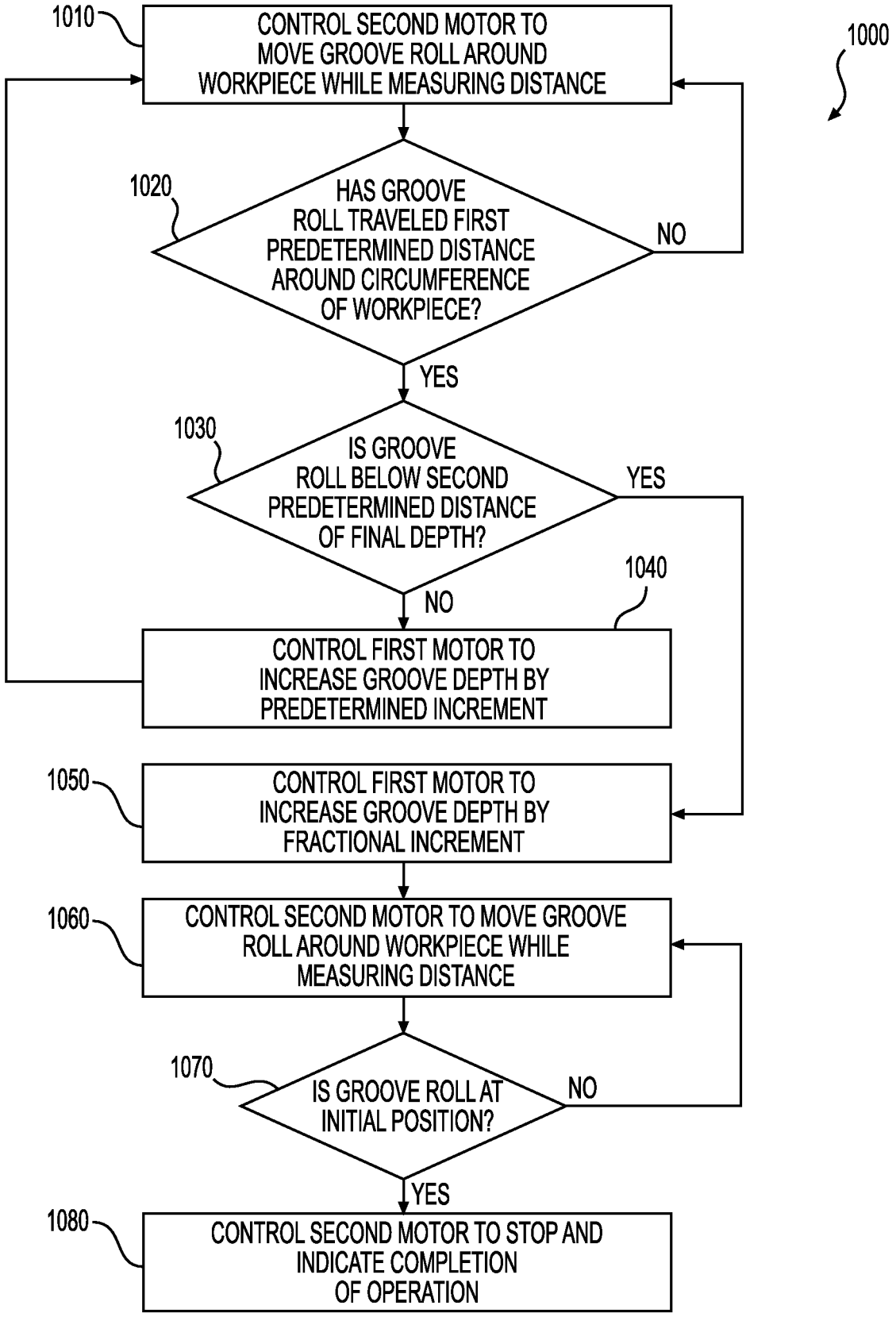
FIG. 10 is a flowchart of a method for operating the roll groover of FIG. 1 in accordance with some embodiments.

FIG. 10 is a flowchart of an example method 1000 for operating the roll groover 100. The method 1000 includes controlling, using the electronic processor 200, the second motor 295 to move the groove roll 145 around the workpiece while measuring distance (at block 1010). The electronic processor 200 controls the second motor 295 using the FET switching module 215. The second motor 295 is controlled to move the groove roll 145 around the track 155 and the workpiece 105. In some embodiments, the distance is measured using the inertial measurement unit 225 based on the difference between the initial position (e.g., home position) and a current position of the groove roll 145 as explained below. In some embodiments, the second rotary encoder 320 is used to measure the distance. As explained above, a linear equation may be derived based on the connection between the second motor 295 and the groove roll 145. The distance traveled can then be calculated using the signals from the second rotary encoder 320 and the linear equation.

The method 1000 includes determining, using the electronic processor 200, whether the groove roll 145 has traveled a first predetermined distance around the circumference of the workpiece 105 (at block 1020). As described above, the electronic processor continuously measures the distance traveled by the groove roll 145 around the circumference of the workpiece 105. The distance is tracked to determine whether the groove roll 145 has reached a point where the groove depth of the groove roll 145 is to be increased. The groove roll 145 starts at an initial groove depth when producing the groove on the workpiece 105. The groove depth is gradually increased until the determined or desired groove depth is achieved in the workpiece 105. The electronic processor continues to operate the second motor 295 until the groove roll 145 has traveled the first predetermined distance around the circumference of the workpiece 105. The first predetermined distance around the circumference may include, for example, half the distance of the circumference, a quarter of the distance of the circumference, a third of the distance of the circumference, or the like.

When the groove roll 145 has traveled the first predetermined distance around the circumference of the workpiece 105, the method 1000 includes determining, using the electronic processor 200, whether the groove roll 145 is below a second predetermined distance of the final depth (at block 1030). As discussed above, the groove depth is gradually increased until the final depth is reached. The depth may be incremented by predetermined distances (for example, the second predetermined distance). However, the final depth may not be an integer multiple of the predetermined depth increments. Accordingly, the electronic processor 200 determines whether the groove roll 145 is below the predetermined depth increment from the final depth.

When the groove roll 145 is not below the second predetermined distance of the final depth, the method 1000 includes controlling, using the electronic processor 200, the first motor 290 to increase groove depth by predetermined increment (at block 1040). Once the groove roll 145 has travelled the first predetermined distance around the circumference of the workpiece 105, the electronic processor 200 stops the second motor to increase the groove depth. In one embodiment, the predetermined increment is the second predetermined distance. The predetermined increment is, for example, a full turn, a half turn, a quarter turn, or the like of the feedscrew used to move the groove roll 145 for increasing or decreasing the depth. The electronic processor 200 controls the first motor 290 to move the groove roll 145 to increase or decrease the groove depth. The method 1000 then continues to block 1010 to operate the second motor 295 and produce the groove in the workpiece 105. The method 1000 continues to gradually increase the groove depth and produce the groove in the workpiece 105 as discussed in blocks 1010-1040 until the groove depth is below the second predetermined distance of the final depth.

When the groove depth is below the second predetermined distance of the final depth, the method 1000 includes controlling, using the electronic processor 200, the first motor 290 to increase groove depth by fractional increment (at block 1050). The fractional increment corresponds to the difference between the final depth (i.e., desired depth) and the current depth. The electronic processor 200 stops the second motor 295 and controls the first motor 290 to turn the feedscrew by the fractional amount for producing the desired groove depth.

The method 1000 includes controlling, using the electronic processor 200, the second motor 295 to move the groove roll 145 around the workpiece while measuring distance (at block 1060). Once the final depth is achieved, the electronic processor 200 controls the second motor 295 to complete the grooving operation on the workpiece 105. The method 1000 includes determine, using the electronic processor 200, whether the groove roll 145 is at the initial position (at block 1070). The electronic processor 200 continues operating the second motor 295 until the groove roll 145 has reached the initial position. In some embodiments, determining that the groove roll 145 has reached the initial position includes determining that the grooving process on the workpiece 105 has been completed.

When the groove roll 145 is at the initial position, the method 1000 includes controlling, using the electronic processor 200, the second motor 295 to stop and indicating completion of operation (at block 1080). Once the grooving process is complete, the electronic processor 200 stops the motor and provides an indication, for example, using the indicators 240. The indication informs the user that the grooving operation is complete. The user may then disarm the roll groover 100 from the workpiece 105.

In some embodiments, the final groove depth and details of the grooving operation may be stored in the memory 255. A user may connect to the roll groover using the external device running the roll groover application 460. The user may compare the final groove depth with the manufacturer's specification for the workpiece 105 on the external device 400.

In some embodiments, the roll groover 100 may include an additional single revolution mode, also referred to as a "1×" mode. The single revolution mode may be activated using a button on the housing 110 of the roll groover 100 or on a user interface of the roll groover 100. In some embodiments, the single revolution mode may be activated using the roll groover application 460, for example, by receiving a selection of the single revolution mode. In the single revolution mode, the groove roll 145 complete a single revolution around the workpiece to perform a groove cut on the workpiece 105. The single revolution mode allows additional applications beyond the current capabilities of the roll groover 100. For example, the single revolution mode allows a user to achieve the desired depth if the automated operation described in FIG. 10 does not result in the desired depth of cut. In some embodiments, a desired depth may be provided for the single revolution mode or other modes. In this embodiment, the groove roll 145 is operated to achieve the desired depth, for example, when the automated operation described in FIG. 10 does not result in the desired depth. In some embodiments, the 1× mode is controlled wireless by an external device (e.g., a smartphone).

The roll groover 100 described above therefore provides several advantages over roll groovers currently in the market. Specifically, the roll groover 100 is operated using motors thereby removing the need for manually operating the roll groover by a crank mechanism. Additionally, the roll groover 100 automatically determines the groove depth and automatically produces the groove in the workpiece 105. This provides a more accurate groove in the workpiece by reducing any human error during operation. The groove depth can be verified using the external device 400. Additionally, the roll groover 100 increases the efficiency and speed of groove rolling operation. Specifically, the user may setup a first operation on a first workpiece 105 by arming a first roll groover 100 on the first workpiece 105 and pressing the run button 125 of the first roll groover 100. While the first roll groover 100 is operating on the first workpiece, the user may setup a second workpiece 105 by arming a second roll groover 100 on the second workpiece 105 and pressing the run button 125 of the second roll groover 100.

An automated roll groover 100 such as the one described herein may be subject to certain safety regulations. For example, the roll groover 100 may have to stop operation when an object is detected within a vicinity of the roll groover 100 that may entangle with the operation of the roll groover 100. The roll groover 100 uses, for example, the LiDAR sensors 330 or other similar proximity detection sensors to detect any objects that may interfere with the operation of the roll groover 100 and stops operation of the roll groover 100 when the objects are detected.

Figure 11:
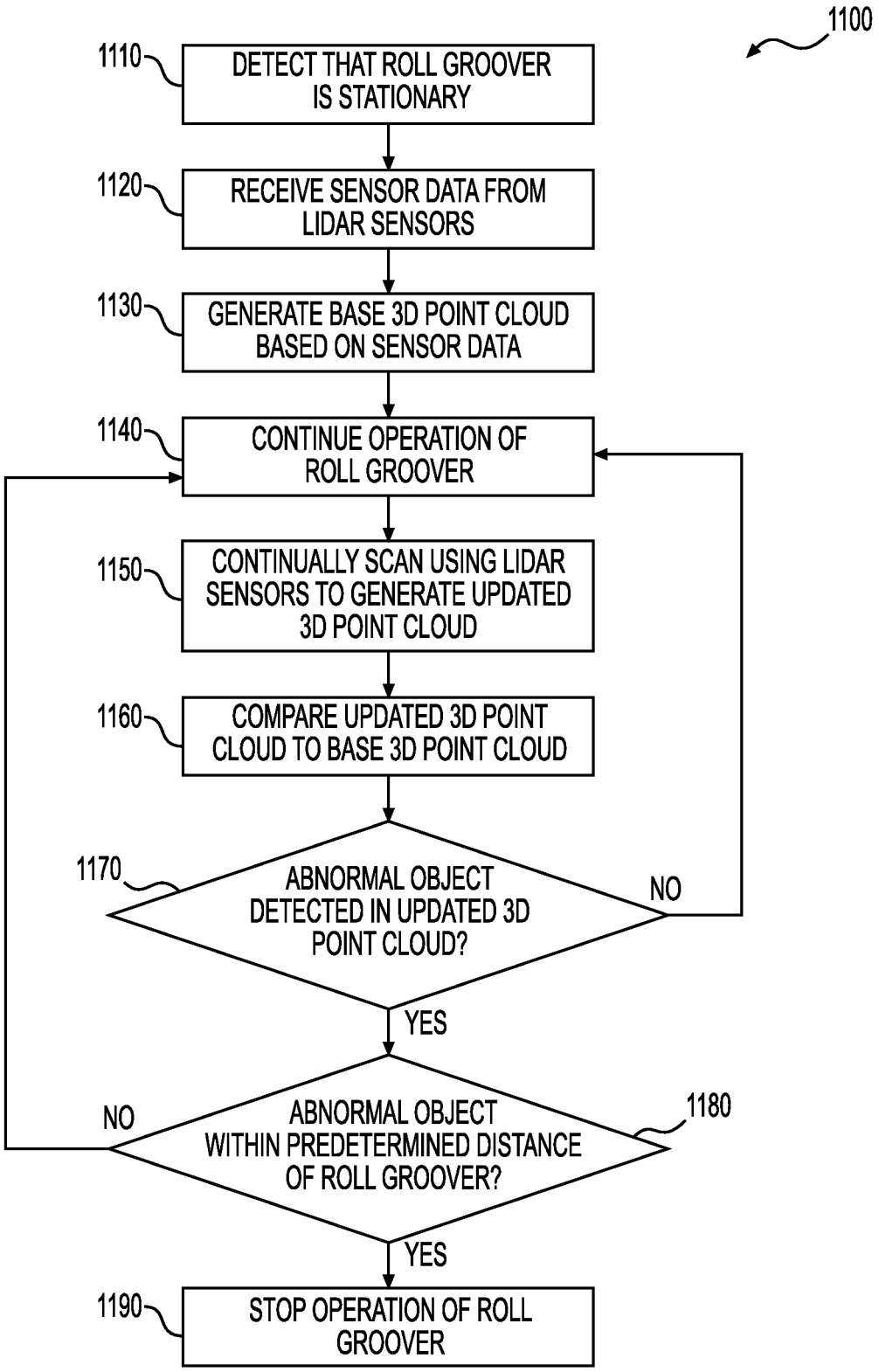
FIG. 11 is a flowchart of a method for entanglement awareness of the roll groover of FIG. 1 in accordance with some embodiments.

FIG. 11 is a flowchart of an example method 1100 for entanglement awareness of the roll groover 100. The method 1100 includes detecting, using the electronic processor 200, that the roll groover 100 is stationary (at block 1110). The electronic processor 200 receives signals from the inertial measurement unit 225 regarding the movement of the roll groover 100. A better 3D model may be obtained when the roll groover 100 is stationary compared to when the roll groover 100 is operating. Specifically, an initial 3D model may be obtained after the roll groover 100 is armed on the workpiece 105 and before the operation of the roll groover 100 has started.

The method 1100 includes receiving, at the electronic processor 200, sensor data from the LiDAR sensors 330 (at block 1120). The LiDAR sensors 330 may include one or more light emitters and one or more light detectors placed in locations around the roll groover 100. The light emitter emits light signals that are reflected by surroundings around the roll groover 100 and detected by the light detectors. The LiDAR sensors 330 provide the detection results to the electronic processor 200.

The method 1100 includes generating, using the electronic processor 200, a base 3D point cloud based on the sensor data (at block 1130). The electronic processor 200 uses the sensor data to create a base 3D model of the surrounding of the roll groover 100. The electronic processor 200 may use commonly known techniques of 3D point cloud construction to generate the base 3D point cloud (e.g., ReCap by Autodesk). The base 3D point cloud can be later used for comparison for detecting whether any object have entered the surrounding of the roll groover 100.

The method 1100 includes continuing, using the electronic processor 200, operation of the roll groover 100 (at block 1140). For example, the electronic processor 200 performs methods 900 and 1000 to produce the groove in the workpiece 105. The method 1100 includes continuously scanning, using the electronic processor 200, the LiDAR sensors to generate updated 3D point cloud (at block 1150). For example, the electronic processor 200 may receive sensor data from the LiDAR sensors at every predetermined interval. The electronic processor 200 continuously updates the 3D point cloud based on the received sensor data.

The method 1100 includes comparing, using the electronic processor 200, the updated 3D point cloud to the base 3D point cloud (at block 1160). The electronic processor 200 compares the updated 3D point cloud to the base 3D point cloud to detect any differences within the point clouds. The method 1100 includes determining, using the electronic processor 200, whether an abnormal object is detected in the updated 3D point cloud (at block 1170). The electronic processor 200 detects objects by comparing the updated 3D point cloud to the base 3D point cloud. An abnormal object is, for example, an object that was not originally present in the base 3D point cloud. When no abnormal object is detected in the updated 3D point cloud, the method 1100 returns to block 1140 to continue operation of the roll groover 100.

When an abnormal object is detected in the updated 3D point cloud, the method 1100 includes determining, using the electronic processor 200, whether the abnormal object is within a predetermined distance of the roll groover 100 (at block 1180). The predetermined distance is, for example, a pre-calibrated distance within which an object may interfere with the operation of the roll groover 100. The distance between the object and the roll groover 100 may be determined using the sensor data from the LiDAR sensors 330. When the abnormal object is not within the predetermined distance of the roll groover 100, the method 1100 returns to block 1140 to continue operation of the roll groover 100.

When the abnormal object is within the predetermined distance of the roll groover 100, the method 1100 includes stopping, using the electronic processor 200, operation of the roll groover 100 (at block 1190). The electronic processor 200 stops the first motor 290 and/or the second motor 295 and may provide an indication to the user. For example, the electronic processor 200 may activate an indicator 240 to inform the user than an abnormal object is detected within the vicinity of the roll groover 100. The electronic processor 200 may resume operation when the object is removed from the vicinity of the roll groover 100. The method 1100 therefore allows the roll groover 100 to meet safety standards as discussed above.

Figure 12:
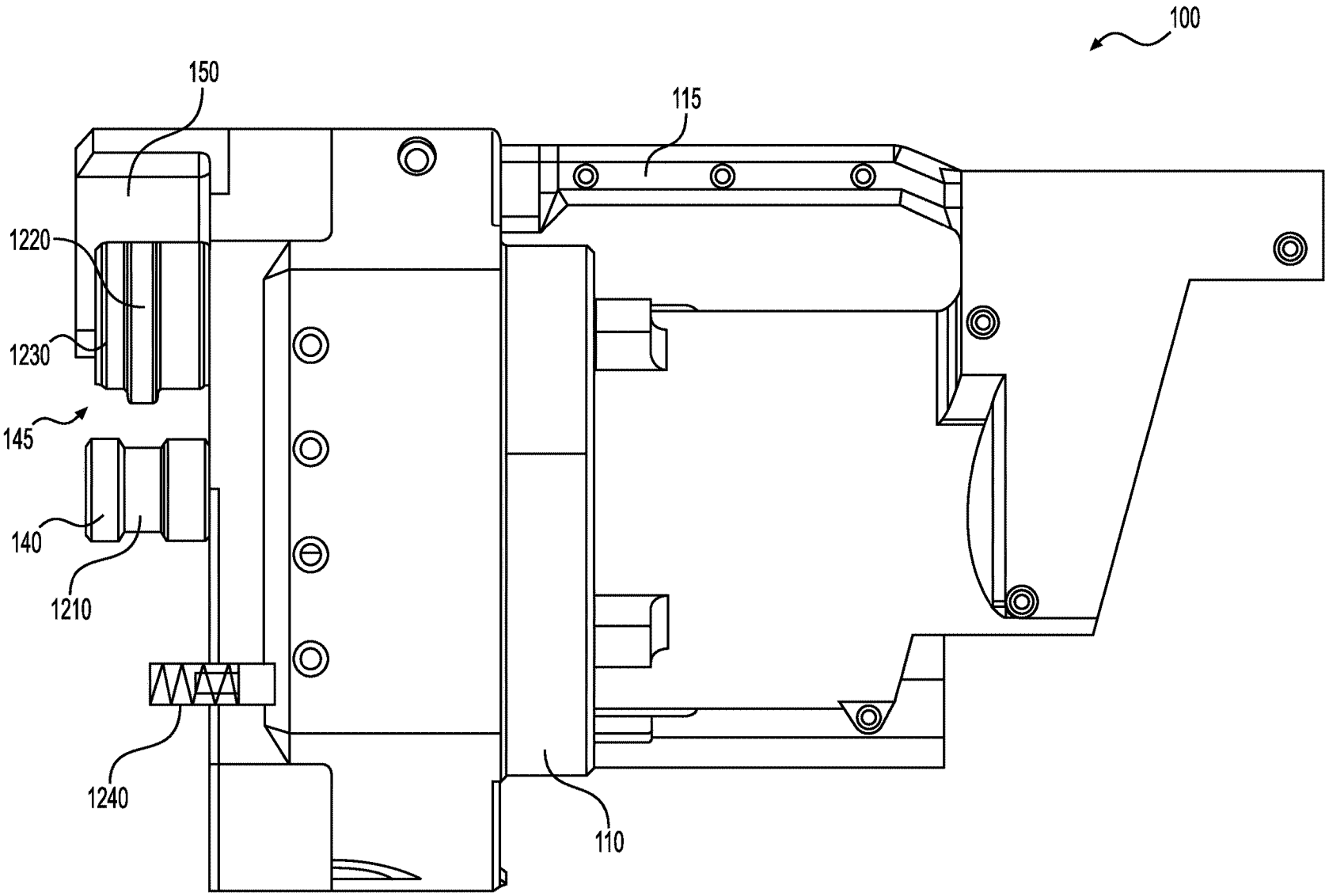
FIG. 12 is a side perspective view of the roll groover of FIG. 1 in accordance with some embodiments.

FIG. 12 is a side perspective view of the roll groover 100 in accordance with an example embodiments. As shown in FIG. 12, the inner roller 140 is, for example, a female roller including a roller groove 1210, and the groove roll 145 is, for example, a male roller including a roller projection 1220. The roller groove 1210 is shaped to correspondingly receive the roller projection 1220. The force exerted by the roller projection 1220 on the outer circumference of the workpiece 105 and the allowance provided by the roller groove 1210 on the inner circumference of the workpiece 105 together produce the groove on the workpiece 105.

The groove roll 145 include a replaceable die 1230 or die set. In some embodiments, both the inner roller 140 and the groove roll 145 include replaceable dies that form part of the die set. The die 1230 is replaceable to produce grooves of different sizes or to accommodate workpieces 105 of different sizes. In some embodiments, the roll groover 100 is configured to detect the type and identification information of the die set. For example, a user may input identification information of the die set in the roll groover application 460 or on a user interface of the roll groover 100. In some embodiments, the roll groover 100 automatically detects the identification information of the die set currently placed on the roll groover 100. The type of the die set may be determined from the identification information. The roll groover 100 may include a radio frequency identity (RFID) reader to read an RFID tag in the die set. The roll groover 100 or the external device 400 may include a QR code or bar code scanner to scan a QR code or bar code on the die set. Each type of die set may include differing electrical contacts. The roll groover 100 may determine the type of die set based on the electrical contacts of the die set. In some embodiments, each type of die set may contact a different combination of a series of switches provided on the roll groover 100. The roll groover 100 may determine the type of die set based on detecting the switches contacted by the dies set.

Figure 13:
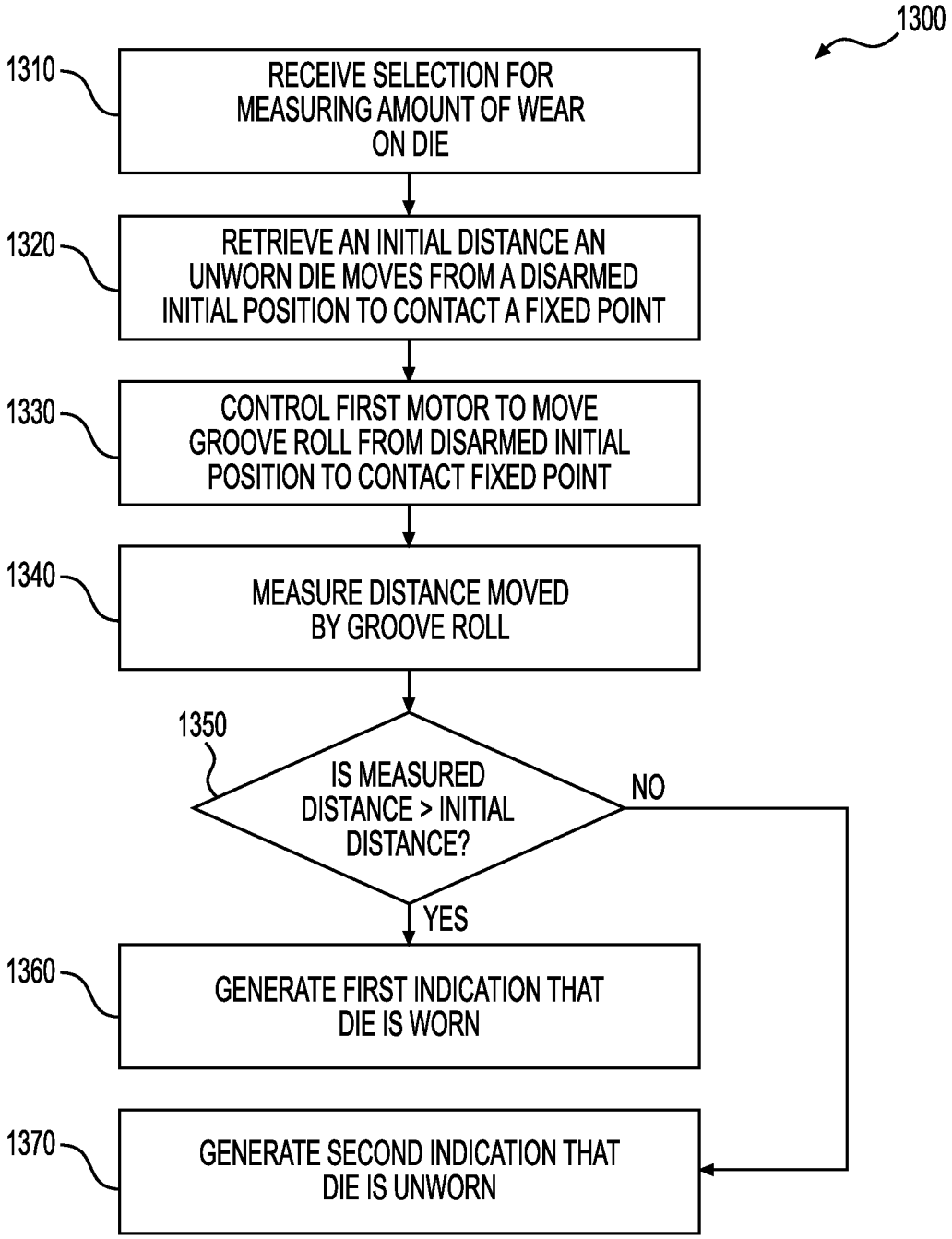
FIG. 13 is a flowchart of a method for measuring an amount of die wear of the roll groover of FIG. 1 in accordance with some embodiments.

Due to the cutting action, the die 1230 may exhibit wear after repeated use. If the die 1230 is not replaced after exhibiting wear, the quality of the groove generated on the workpiece 105 may deteriorate. In some embodiments, the roll groover application 460 may alert a user to check for wear on the die 1230. FIG. 13 is a flowchart of an example method 1300 for measuring die wear. The method 1300 includes receiving a first selection for measuring an amount of wear on the die 1230 (at block 1310). The first selection may be received on a user interface of the roll groover 100. For example, the user may press a button on the roll groover 100 to initiate measuring die wear. In some embodiments, the first selection may be received on the external device 400 (e.g., a smartphone). Specifically, the external device 400 may track the age of the die 1230 and provide periodic alerts to the user to measure die wear. In response, the user may select an option on the roll groover application 460 to measure die wear.

The method 1300 includes retrieving an initial distance an unworn die moves from a disarmed initial position to contact a fixed point (at block 1320). The initial distance may be determined during manufacturing and may be stored in the memory 255 or the device memory 420. When measuring die wear is initiated, the roll groover 100 retrieves the initial distance from the memory 255. Alternatively, the external device 400 retrieves the initial distance from the device memory 420. The disarmed initial position may refer to the position of the groove roll 145 when the roll groover 100 is disarmed as discussed above with respect to method 700. The fixed point may refer to the inner roller 140. The initial distance is therefore the distance moved by the groove roll 145 when the groove roll 145 is moved from the disarmed initial position to contact the inner roller 140.

The method 1300 further includes controlling, using the electronic processor 200, the first motor 290 to move the groove roll 145 from the disarmed initial position to the fixed point in response to receiving the first selection (at block 1330). The electronic processor 200 controls the first motor 290 using the FET switching module 215. The first motor 290 is controlled to move the groove roll 145 towards the inner roller 140.

The method 1300 also includes measuring, using the electronic processor 200, a distance moved by the groove roll 145 when the groove roll 145 is moved from the disarmed initial position to contact the fixed point (at block 1340). In some embodiments, the measured distance is measured using the inertial measurement unit 225. In other embodiments, the measured distance is measured using the first rotary encoder 310 or revolutions of the motor 290, 295. As the die wears, the groove roll 145 travels farther to contact the fixed point compared to an unworn die.

The method 1300 includes determining whether the measured distance is greater than the initial distance (at block 1350). As the die wears, the groove roll 145 travels farther to contact the fixed point compared to an unworn die. Accordingly, when the measure distance is greater than the initial distance, the electronic processor 200 determines that the die 1230 is worn. In some embodiments, the electronic processor 200 determines that the die 1230 is worn when the measured distance is greater than the initial distance by more than a predetermined amount.

When the measured distance is greater than the initial distance, the method 1300 includes determining that the die 1230 is worn and generating a first indication that the die 1230 is worn (at block 1360). When the measured distance is not greater than the initial distance, the method 1300 includes determining that the die 1230 is not worn and generating a second indication that the die 1230 is unworn (at block 1370). The first and second indication may be provided on a user interface of the roll groover 100 (for example, using the indicators 240) or on a user interface of the external device 400. When the die 1230 is worn, the external device 400 may prompt the user to replace the die 1230 or to recalibrate the roll groover 100. Recalibrating the roll groover 100 adjusts the initial position (e.g., the home position) based on the worn amount such that the roll groover 100 may accurately produce the groove on the workpiece 105.

Figure 14:
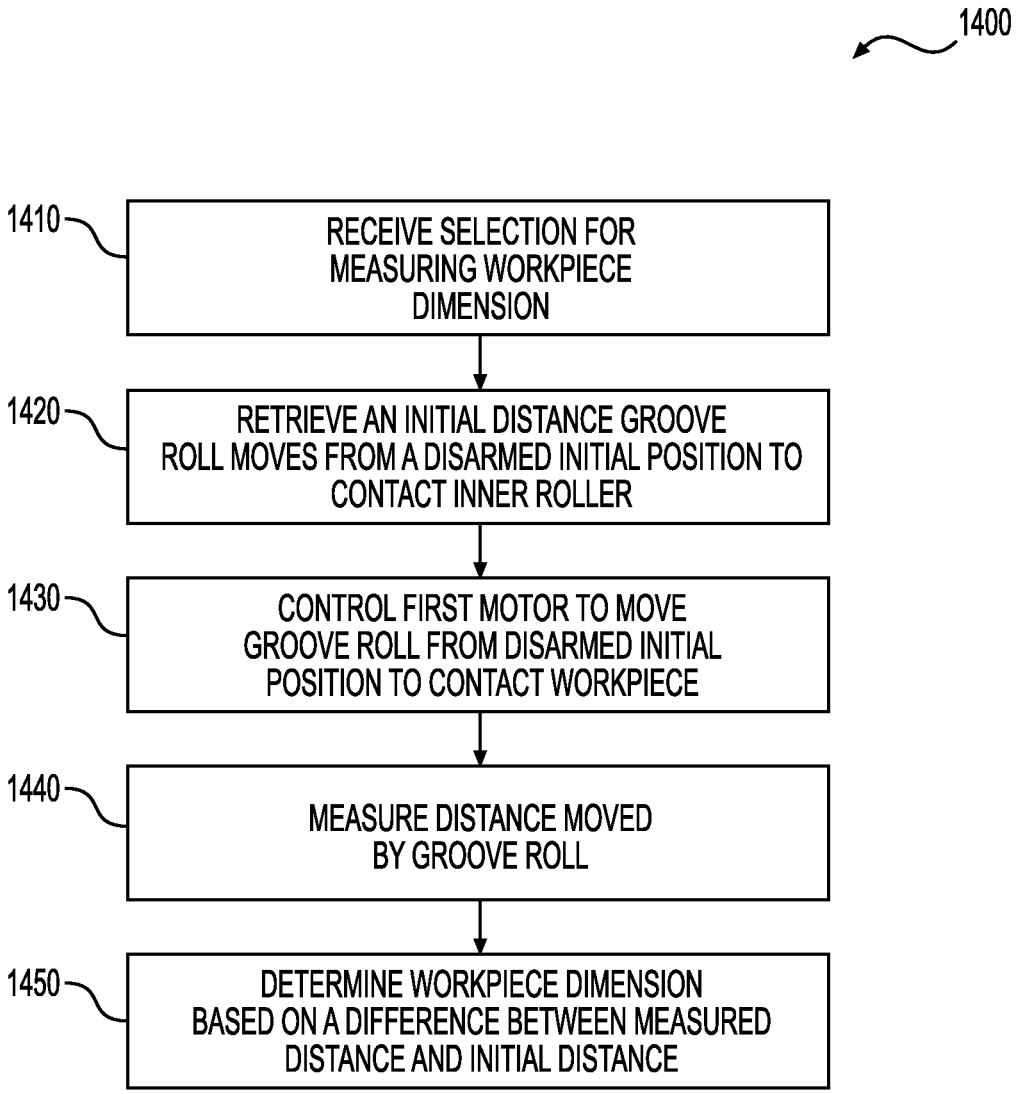
FIG. 14 is a flowchart of a method for measuring a workpiece dimension using the roll groover of FIG. 1 in accordance with some embodiments.

In some embodiments, the groove roll 145 may also be used to determine dimensions of the workpiece 105. The dimensions of the workpiece 105 include, for example, a thickness of the workpiece 105 (e.g., pipe) or a depth of a groove in the workpiece 105. FIG. 14 is a flowchart of an example method 1400 for measuring workpiece dimension. The method 1400 includes receiving a second selection for measuring a workpiece dimension (at block 1410). The second selection may be received on a user interface of the roll groover 100. For example, the user may press a button on the roll groover 100 to initiate measuring workpiece dimension. In some embodiments, the second selection may be received on the external device 400. Specifically, the user may select an option on the roll groover application 460 to measure a workpiece dimension. The workpiece dimension is, for example, a thickness of the workpiece 105 or a depth of a groove in the workpiece 105.

The method 1400 includes retrieving an initial distance the groove roll moves from a disarmed initial position to contact the inner roller 140 (at block 1420). The initial distance may be determined during manufacturing and may be stored in the memory 255 or the device memory 420. When measuring workpiece dimension is initiated by the second selection, the roll groover 100 retrieves the initial distance from the memory 255. Alternatively, the external device 400 retrieves the initial distance from the device memory 420. The disarmed initial position may refer to the position of the groove roll 145 when the roll groover 100 is disarmed as discussed above with respect to method 700. The initial distance is therefore the distance moved by the groove roll 145 when the groove roll 145 is moved from the disarmed initial position to contact the inner roller 140.

The method 1400 further includes controlling, using the electronic processor 200, the first motor 290 to move the groove roll 145 from the disarmed initial position to contact the workpiece 105 in response to receiving the second selection (at block 1430). The electronic processor 200 controls the first motor 290 using the FET switching module 215. The first motor 290 is controlled to move the groove roll 145 towards the inner roller 140.

The method 1400 also includes measuring, using the electronic processor 200, a distance moved by the groove roll 145 when the groove roll 145 is moved from the disarmed initial position to contact the workpiece 105 (at block 1440). In some embodiments, the measured distance is measured using the inertial measurement unit 225. In other embodiments, the measured distance is measured using the first rotary encoder 310.

The method 1400 includes determining the workpiece dimension based on a difference between the measured distance and the initial distance (at block 1450). The thickness of the workpiece 105 can be determined by subtracting the measured distance from the initial distance. The groove depth can be determined by subtracting a measured thickness of the workpiece 105 from a known thickness of the workpiece. The known thickness of the workpiece can be determined based on identifying the type of workpiece 105 and retrieving prestored values for each type of workpiece 105. The groove depth measured by method 1400 is the depth of a groove currently present in a workpiece 105. The groove depth measured by method 1400 is therefore distinct from the groove depth measured by method 900. The groove depth measured by method 1400 pertains to a groove depth that is to be ultimately achieved by the operation of the roll groover 100 (i.e., a prospective groove depth) based on a "C" dimension of the workpiece 105.

In some embodiments, the method 1400 may also be used to determine whether a workpiece 105 has already been grooved. For example, the electronic processor 200 compares the workpiece dimension to an expected thickness of the workpiece 105. The electronic processor 200 determines that the workpiece 105 is already grooved when the workpiece dimension is smaller than the expected thickness of the workpiece 105. The electronic processor 200 may also determine whether the workpiece 105 is grooved to an expected specification by determining the difference between workpiece dimension and the expected thickness and comparing the difference to a predetermined threshold. The predetermined threshold corresponds to the expected groove depth for the particular type of workpiece 105. When the electronic processor 200 determines that the groove depth does not match the expected specification, the electronic processor 200 continues operation of the roll groover 100 to roll a groove on the workpiece 105. When the electronic processor 200 determines that the groove depth matches the expected specification, the electronic processor 200 stops operation of the roll groover 100.

In some embodiments, the roll groover 100 may also perform walk-off detection to detect whether the roll groover 100 is moving away from the workpiece 105 in the Z-axis (i.e., in the axial direction of the workpiece 105). The walk-off detection may be performed using, for example, a limit switch 1240 (see FIG. 12) provided on the housing 110 of the roll groover 100. The limit switch 1240 may be a biased physical switch provided at an interface of the workpiece 105 and the housing 110. The limit switch 1240 is normally biased into an open position (e.g., OFF position). When the workpiece 105 is properly attached to the housing 110 for operation, the workpiece 105 depresses/actuates the limit switch 1240 to a closed position (e.g., ON position). When in the closed position, the physical limit switch 1240 may close (i.e., turn ON) an electronic limit switch. When closed, the electronic limit switch provides a signal to the electronic processor 200 indicating that the workpiece 105 is properly attached to the housing 110. When the workpiece 105 begins to walk-off, the workpiece releases the limit switch 1240, which moves into an open position due to a biasing force and which in turn opens the electronic limit switch. In the absence of a signal from the electronic limit switch, the electronic processor 200 detects walk-off of the workpiece 105 from the roll groover 100. In some embodiments, the electronic limit switch may be closed or turned ON when the physical limit switch 1240 is not depressed/actuated. In these embodiments, the electronic processor 200 detects walk-off when a signal is detected from the electronic limit switch as the electronic limit switch is turned ON when the physical limit switch 1240 is released. The physical limit switch 1240 may be configured such that the electronic limit switch is turned ON/OFF prior to complete disengagement of the workpiece 105 from the housing 110.

In some embodiments, walk-off detection is performed using, for example, the inertial measurement unit 225 based on the displacement of the roll groover 100 during operation. Specifically, the electronic processor 200 monitors the movement of the roll groover 100 in the Z-axis using the inertial measurement unit 225. When a movement in the Z-axis exceeds a predetermined walk-off threshold, the electronic processor 200 detects a walk-off of the workpiece 105 from the roll groover 100.

In some embodiments, the roll groover 100 may also be used to detect an oblong pipe (e.g., not the correct shape to fit a coupling). For example, the inertial measurement unit 225 detects the movement of the groove roll 145 around the workpiece 105. The roll groover 100 may store a predetermined profile of the inertial measurement unit 225 measurements for a circular pipe. The electronic processor 200 detects an oblong pipe when the measurements for the current movement of the groove roll 145 deviate from the predetermined profile. In some embodiments, the roll groover 100 may also be used to detect a flared pipe, that is, when the outer edge of the workpiece 105 is flared. The roll groover 100 includes a sensor to detect an angle of the roll groover 100 compared to the workpiece 105. The electronic processor 200 detects a flared pipe when the detected angle deviates from a predetermined angle. The sensor for detecting a flared pipe includes, for example, the inertial measurement unit 225, the LIDAR sensors 330, an ultrasonic sensor, and the like. The inertial measurement unit 225 may be used to detect the current profile (e.g., an inner diameter and shape of a pipe) of the workpiece 105 and detect a flared pipe when the current profile deviates from an expected profile. The LIDAR sensors 330 or the ultrasonic sensor may be used to measure the distance of various points of the workpiece 105 to detect a flared pipe.

Thus, embodiments described herein provide, among other things, a roll groover for producing connection grooves on pipes.

What is claimed is:

1. A roll groover comprising:
- a housing;
- an inner roller provided on the housing and configured to be received in an inner circumference of a workpiece;
- a groove roll provided on the housing and configured to produce a groove on the workpiece;
- one or more motors provided within the housing and configured to drive the groove roll;
- an electronic processor electrically connected to the one or more motors, the electronic processor configured to:
  - control the one or more motors to move the groove roll around the workpiece while measuring distance,
  - determine whether the groove roll has traveled a first predetermined distance around a circumference of the workpiece,
  - determine whether the groove roll is below a second predetermined distance of a final depth when the groove roll has traveled the first predetermined distance,
  - in response to the groove roll not being below the second predetermined distance of the final depth, control the one or more motors to increase groove depth by a predetermined increment; and
  - in response to the groove roll being below the second predetermined distance of the final depth:
    - control the one or more motors to increase groove depth by a fractional increment,
    - control the one or more motors to move the groove roll around the workpiece,
    - determine whether the groove roll is at an initial position, and
    - control the one or more motors to stop and indicate completion of operation when the groove roll is at the initial position.

2. The roll groover of claim 1, wherein the one or more motors includes:
- a first motor configured to drive the groove roll in a radial direction; and
- a second motor configured to drive the groove roll in a circumferential direction.

3. The roll groover of claim 1, further comprising a battery pack configured to power the one or more motors.

4. The roll groover of claim 1, further comprising:
- a roll casing provided on the housing, wherein the groove roll is mounted to and is configured to move with the roll casing, wherein the roll casing is configured to move with the groove roll to produce the groove on the workpiece.

5. The roll groover of claim 1, wherein the electronic processor is further configured to:

receive a selection of a single revolution mode; and control the one or more motors to complete a single revolution of the groove roll around the workpiece.

6. A roll groover comprising:

a housing;

an inner roller provided on the housing and configured to be received in an inner circumference of a workpiece;

a groove roll provided on the housing and configured to produce a groove on the workpiece;

one or more motors provided within the housing and configured to drive the groove roll;

a battery pack configured to power the one or more motors; and an electronic processor electrically connected to the one or more motors, the electronic processor configured to:

operate the one or more motors to perform a first operation of moving the groove roll in a radial direction, wherein the first operation is performed to adjust a groove depth on the workpiece, and operate the one or more motors to perform a second operation of moving the groove roll in a circumferential direction, wherein the second operation is performed to produce the groove on the workpiece.

7. The roll groover of claim 6, wherein the one or more motors includes:

a first motor configured to drive the groove roll in the radial direction; and a second motor configured to drive the groove roll in the circumferential direction.

8. The roll groover of claim 6, wherein the electronic processor is further configured to:

control the one or more motors to move the groove roll around the workpiece while measuring a distance; and increase, using the one or more motors, groove depth in predetermined increments for each rotation of the groove roll by a first predetermined distance.

9. The roll groover of claim 6, further comprising:

a roll casing provided on the housing, wherein the groove roll is mounted to and configure to move with the roll casing, wherein the roll casing with the groove roll are configured to move in the circumferential direction to produce the groove on the workpiece.

10. The roll groover of claim 6, further comprising:

a jog trigger configured to control the first operation;

a run switch configured to control the second operation; and a direction switch configured to select a direction of movement of the groove roll.

11. The roll groover of claim 6, further comprising one or more circuit boards provided within the housing and including electronic components of the roll groover, wherein the one or more circuit boards include a total surface area of less than 155 centimeters squared ($cm^2$).

12. The roll groover of claim 6, wherein the electronic processor is further configured to:

control the one or more motors to move the groove roll around the workpiece while measuring distance;

determine whether the groove roll has traveled a first predetermined distance around a circumference of the workpiece;

determine whether the groove roll is below a second predetermined distance of a final depth when the groove roll has traveled the first predetermined distance;

in response to the groove roll not being below the second predetermined distance of the final depth, control the one or more motors to increase groove depth by a predetermined increment; and in response to the groove roll being below the second predetermined distance of the final depth:

control the one or more motors to increase groove depth by a fractional increment, control the one or more motors to move the groove roll around the workpiece, determine whether the groove roll is at an initial position, and control the one or more motors to stop and indicate completion of operation when the groove roll is at the initial position.

13. The roll groover of claim 6, wherein the groove roll is a replaceable die.

14. The roll groover of claim 13, wherein the electronic processor is further configured to:

receive a selection for measuring an amount of wear on the replaceable die;

retrieve an initial distance an unworn replaceable die moves from a disarmed initial position to contact a fixed point;

control the one or more motors to move the groove roll from the disarmed initial position to the fixed point in response to receiving the selection;

measure a distance moved by the groove roll when the groove roll is moved from the disarmed initial position to contact the fixed point;

determine whether the measured distance is greater than the initial distance;

generate a first indication that the replaceable die is worn when the measured distance is greater than the initial distance; and generate a second indication that the replaceable die is unworn when the measured distance is not greater than the initial distance.

15. A method of operating a roll groover including an inner roller configured to be received in an inner circumference of a workpiece and a groove roll configured to produce a groove on the workpiece, the method comprising:

operating, using an electronic processor, one or more motors to perform a first operation of moving the groove roll in a radial direction, wherein the first operation is performed to adjust a groove depth on the workpiece;

operating, using the electronic processor, the one or more motors to perform a second operation of moving the groove roll in a circumferential direction, wherein the second operation is performed to produce the groove on the workpiece; and providing, using a battery pack, power to the one or more motors.

16. The method of claim 15, further comprising:

controlling the one or more motors to move the groove roll around the workpiece while measuring a distance; and increasing, using the one or more motors, groove depth in predetermined increments for each rotation of the groove roll by a first predetermined distance.

17. The method of claim 15, further comprising:

controlling the one or more motors to move the groove roll around the workpiece while measuring distance;

determining whether the groove roll has traveled a first predetermined distance around a circumference of the workpiece;

determining whether the groove roll is below a second predetermined distance of a final depth when the groove roll has traveled the first predetermined distance;

in response to the groove roll not being below the second predetermined distance of the final depth, controlling the one or more motors to increase groove depth by a predetermined increment; and in response to the groove roll being below the second predetermined distance of the final depth:

controlling the one or more motors to increase groove depth by a fractional increment, controlling the one or more motors to move the groove roll around the workpiece, determining whether the groove roll is at an initial position, and controlling the one or more motors to stop and indicate completion of operation when the groove roll is at the initial position.

18. The method of claim 17, further comprising:

receiving a selection of a single revolution mode; and controlling the one or more motors to complete a single revolution of the groove roll around the workpiece.

* * * * *